US006631972B2

(12) United States Patent
Yazawa

(10) Patent No.: US 6,631,972 B2
(45) **Date of Patent: *Oct. 14, 2003**

(54) INK-JET RECORDING APPARATUS AND CONTROL METHOD THEREOF

(75) Inventor: Takeshi Yazawa, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/324,653

(22) Filed: Jun. 3, 1999

(65) Prior Publication Data

US 2002/0054182 A1 May 9, 2002

(30) Foreign Application Priority Data

Jun. 3, 1998 (JP) ..... 10/155017

(51) Int. Cl.[7] ..... B41J 2/165
(52) U.S. Cl. ..... 347/23; 347/30
(58) Field of Search ..... 347/23, 7, 10, 347/19, 20, 86, 30, 33

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,723,129 A | | 2/1988 | Endo et al. | 347/56 |
| 4,740,796 A | | 4/1988 | Endo et al. | 347/56 |
| 5,382,969 A | * | 1/1995 | Mochizuki et al. | 347/23 |
| 5,617,525 A | * | 4/1997 | Sugaya | 395/805 |
| 5,638,100 A | | 6/1997 | Kanematsu et al. | 347/35 |
| 5,949,447 A | * | 9/1999 | Arai et al. | 347/23 |
| 5,992,961 A | * | 11/1999 | Ishikawa et al. | 347/7 |
| 6,151,039 A | * | 11/2000 | Hmelar et al. | 347/7 |

FOREIGN PATENT DOCUMENTS

| | | | |
|---|---|---|---|
| EP | 0 615 846 | * | 9/1994 |
| EP | 0 694 403 | * | 1/1996 |
| EP | 0 714 776 | | 6/1996 |
| EP | 0 816 102 | * | 1/1998 |
| EP | 0 825 567 | | 2/1998 |
| EP | 0 872 345 | | 10/1998 |
| JP | 59-123670 | | 7/1984 |
| JP | 59-138461 | | 8/1984 |
| WO | WO 92/18335 | * | 10/1992 |

* cited by examiner

*Primary Examiner*—Shih-wen Hsieh
(74) *Attorney, Agent, or Firm*—Fitzpatrick, Cella, Harper & Scinto

(57) ABSTRACT

An ink-jet recording apparatus for effecting recording using an ink-jet recording head is capable of forming large dots and small dots. The number of times of discharge operation for forming large dots and the number of times of discharge operation for forming small dots are separately counted, and a total ink discharge amount is calculated on the basis of these count values. The total ink discharge amount which is compared with a predetermined value to perform appropriate suction processing. According to the invention, an ink suction operation from a discharge port is started with appropriate timing, thereby controlling consumption of ink.

21 Claims, 29 Drawing Sheets

INK-JET PRINTER CONTROL CIRCUIT

| 2-BIT INPUT | DECODE OUTPUT | |
|---|---|---|
| | ODD | EVEN |
| 0 0 | × | × |
| 0 1 | × | ○ |
| 1 0 | ○ | ○ |

FIG.13

:SMALL DOT

:LARGE DOT

INK-JET RECORDING APPARATUS AND CONTROL METHOD THEREOF

This application is based on Patent Application No. 10-155017(1998) filed Jun. 3, 1998 in Japan, the content of which is incorporated hereinto by reference.

BACKGROUND OF THE INVENTION

1. Field of the Invention

The present invention relates to an ink-jet recording apparatus for discharging ink from a recording head to a recording material to effect recording and to a control method of the apparatus.

2. Description of the Prior Art

A recording apparatus such as a printer, a copier, a facsimile or the like is constructed to record an image comprising a dot pattern according to image information on the recording material such as paper, cloth, plastic film and the like.

Recording apparatuses can be divided into an ink-jet type, a wire-dot type, a thermal type, a laser beam type and the like according to the recording method; of these, the ink-jet type (ink-jet recording apparatus) is constructed so that an ink (recording liquid) drop is discharged from a discharge port of the recording head to adhere to the recording material thereby achieving recording.

Recently, an increased number of recording apparatuses have been used, and high-speed recording, high resolution, high image quality, and low noise are required for these recording apparatuses. The ink-jet recording apparatus can be one of recording apparatuses which meet such requirements.

To achieve a high-quality printed image, recently various attempts are being made for outputting pictorial images using an ink-jet printer. One of the examples is a recording method which uses a reduced dot diameter of ink droplet. By reducing the dot diameter, a particulate state (coarse feeling due to ink droplets) in a high-contrast portion can be reduced.

However, if the dot diameter of all ink droplets is reduced, an increased number of dots to that extent must be applied, which increases the amount of data and the time required for printing.

For example, FIGS. 29A and 29B show cases of printing with densities of 360 dpi (dots/inch) and 720 dpi in an area of 1/360 inch square. When printed with 360 dpi, recording is completed by only one dot in the area; however, when printed with 720 dpi, recording is not completed unless up to four dots are recorded in the area. It can be seen that even when printing in the same area, if the resolution is increased to two times and the dot diameter is reduced, four times the number of dots, that is, four times the amount of data, are required.

The dot diameter of an ink droplet on paper increases with increasing ink amount discharged from the discharge port of the print head. To increase the amount of ink droplet discharged from the discharge port, energy applied for ink discharge is increased, or for the case of a thermal ink-jet printer using an electrical-thermal conversion element (discharge heater), the area of the discharge heater is increased.

For example, when the area of the discharge heater per one nozzle (unless otherwise specifically noted, hereinafter used to collectively refer to the discharge port, a liquid passage communicating with the discharge port and a device to generate energy utilized for discharging) is enlarged, the size of a formed bubble is also increased by the function of thermal energy, the ink amount pushed out by the bubble is increased, and an ink droplet of large dot diameter can be formed. Hereinafter, this is called a large dot. On the contrary, when the area of the discharge heater per one nozzle is decreased, the size of the formed bubble is also decreased, and, as a result, the discharge ink amount is decreased, and an ink droplet of small dot diameter can be formed. Hereinafter, this is called a small dot.

Further, by appropriately determining the shape, size, disposition or number of discharge heaters so that a bubble covering a large area of the discharge heater is formed when printing a large dot, and a bubble covering a small area of the discharge heater is formed when printing a small dot, that is, by varying the area of bubble generation, it is possible to selectively print a large dot and a small dot even with a single nozzle.

As described above, a recording head is developed which is capable of selectively printing large and small dots by controlling application of energy (applied energy) provided for the discharge operation. By using this recording head, high image quality can be achieved with an ink-jet recording apparatus.

Still further, for the ink-jet recording apparatus, since an ink is discharged from the recording head, stabilization of ink discharge and stabilization of ink discharge amount are required in order to meet the above requirements. Stabilization of ink discharge is achieved by the following means.

Specifically, in the ink-jet recording apparatus, a cap for capping the discharge port is provided which is used to make suction recovery operation for eliminating or preventing discharge trouble by sucking the ink from the discharge port of the recording head.

Yet further, there is a case in which in association with the progress of discharge operation, ink splashed back from the printing medium or mist and the like generated during discharging accumulate in the vicinity of the discharge port, and the accumulated ink adheres to the discharge port resulting in discharge trouble such as discharge failure or altered discharge direction. To prevent this, a construction is employed in which ink on the surface is removed by wiping the surface (face) where the discharge port of the recording head is disposed with a wiping member such as urethane rubber or the like. Although the wiping performance of the wiping member depends on the material quality and mechanical setting conditions, to always maintain its performance, it is more preferable that the surface of the wiping member itself be clean. For this purpose, a cleaning mechanism is often provided which presses the wiping member against an absorber to absorb the ink removed by wiping.

In the ink-jet recording apparatus, in general, ink suction in the ink flow passage of the recording head and wiping of the face are performed to maintain good discharge performance of the recording head for the purpose of preventing occurrence of printing troubles due to discharge failure (an ink droplet is not discharged from the nozzle for discharge operation, resulting in white stripes on the printed matter) caused by a bubble generated or mixed in the ink flow passage or liquid passage of the recording head, or printing troubles due to "dot mis-alignment" (discharged ink is not ejected in the desired direction, resulting in white stripes on the printed matter) caused by wetting of the face of the recording head.

Wetting of the face of the recording head is also generated by the fact that the ink discharged from the discharge port is pulled from the discharge port by a surface tension of the ink and does not flow back to the liquid passage after ink discharge but appears on the face and stays there. When ink is discharged in the state in which ink remains on the periphery of the discharge port, the discharged ink is affected by the surface tension of the ink on the periphery of the discharge port, is not discharged in the predetermined direction, and appears as dot mis-alignment in the image on the printing material. Further, the wetting of the face become considerable with increasing ink discharge times.

Still further, a bubble in the ink flow passage or liquid passage of the recording head is formed while air dissolved in the ink repeats bubble generation and shrinkage due to the temperature of the recording head. When such a bubble is formed, a space not filled with ink is produced in the liquid passage which is to be filled with ink, and a discharge operation is not performed even if sufficient energy is applied, thus resulting in a printing trouble on the recording material. Yet further, such a bubble becomes liable to be formed with increasing ink discharge times.

For these reasons, it is strongly desirable to perform recovery operations such as suction and wiping when discharge times are increased; however, excessive suction tends to increase ink consumption. Further, the suction operation and wiping require interruption of the printing operation, which leads to a decrease in recording throughput.

The timing for performing the recovery operation can be determined at the time the count value of the number of discharged dots exceeds a predetermined value, thereby minimizing the number of recovery operation times including suction and wiping. Similarly, the number of dots is counted from which the amount of ink remaining in the ink supply source such as an ink tank can be calculated. Dot counting is achieved by counting electrical signals sent for generating heat by the discharge heater.

Uniform counting of all of the electrical signals is sufficient for a head which does not discharge both large and small dots from the same head. However, it is to be noted that the volumes of a large dot and a small dot differ when a head which can select large and small dots is used.

In general, a head discharging large dots is more liable to generate a bubble in the ink flow passage than a head discharging small dots, and is more liable to cause wetting of the face. From this fact, if the dot count is performed uniformly, and the recovery operation is controlled according to the counting, there is a fear that even when printing is made solely with small dots and thus there is almost no generation of an undesired bubble, suction is performed to dissipate the ink, resulting in an increase in running cost. Further, there is a fear that even when printing is made solely with small dots and there is almost no wetting of the face, wiping is performed, resulting in unnecessary interruption of the recording operation, that is, a decrease in recording throughput. Still further, if the dot count is performed uniformly regardless of discharge of large dots and discharge of small dots, as to the detection of ink remaining amount, because the difference in ink amount between large dots and small dots is not taken into consideration, there is a fear that the ink remaining amount is incorrectly determined to be "0" even if ink still remains in the ink tank.

SUMMARY OF THE INVENTION

With the aim of solving such problems, in accordance with the present invention, there is provided an ink-jet recording apparatus for making recording using an ink-jet recording head capable of discharging an ink in differing amounts from a discharge port, characterized by comprising ink discharge amount changing means for changing the ink discharge amount from an ink-jet recording head, accumulation means for accumulating data corresponding to ink discharge amount from the ink-jet recording head according to the change, and control means for performing processing for maintaining the ink discharge operation according to the accumulated data.

Further, according to the present invention, there is provided a control method of an ink-jet recording apparatus for making recording using an ink-jet recording head capable of discharging an ink in differing amounts from a discharge port, characterized by comprising an ink discharge amount changing step for changing ink discharge amount from the ink-jet recording head, an accumulation step for accumulating data corresponding to ink discharge amount from the ink-jet recording head, and a control step for performing processing for maintaining the ink discharge operation according to the accumulated data.

In the above, the processing for maintaining the discharge operation can include at least one of a recovery processing for maintaining ink performance from the ink-jet recording head, and a processing for detecting ink remaining amount of an ink supply source for the ink-jet recording head.

Here, the recovery processing can include at least one of an elimination processing for forcibly eliminating ink from the discharge port, and a cleaning processing for cleaning a surface provided with the discharge port of the ink-jet recording head.

In the processing for detecting the ink remaining amount, in the control means or step, the data corresponding to the forcibly eliminated ink amount can be taken into consideration.

The elimination processing can include a suction processing for sucking ink from the discharge port, and the cleaning processing can include a processing for wiping the surface.

In the ink discharge amount changing means or step, a change is performed to the ink-jet recording head so that at least two types of dots, large and small, can be formed on the recording medium, the accumulation means or step may comprise dot count means or step for separately counting the number of times of discharge operation for forming large dots and the number of times of discharge operation for forming small dots, respectively.

Alternatively, in the ink discharge amount changing means or step, a change is performed for the ink-jet recording head to be able to form at least two types of dots, large and small, on the recording medium, and in the accumulation means or step, data corresponding to the discharge operation for forming large dots and data corresponding to the discharge operation for forming small dots can be collectively counted.

In the above description, the ink-jet recording head can be one which has a plurality of heat generation resistors substantially differing in heat generation amount for generating thermal energy as an energy utilized for discharging the ink, or a plurality of heat generation resistors substantially same in heat generation amount, disposed corresponding to the discharge port.

In the ink discharge amount changing means or step, the change can be performed by selectively driving the plurality of heat generation resistors.

Further, the heat generation resistor can be one which generates thermal energy for making the ink to cause film boiling.

In the present specification, "recording" (hereinafter in some cases referred to as "print" or "printing") means not only a case for forming significant information such as a pattern or the like, but also a case for forming an image, figure, pattern or the like on various types of recording media, whether or not it is to be recognizable by humans using the visual sense, or a case for processing such media.

Further, "recording medium" means not only paper used for a general recording apparatus, but also cloth, plastic film, a metal plate or the like and one which can accept ink discharged by the head.

Still further, "ink" is to be broadly interpreted as in the definition of the above "recording", and means a liquid which is applied onto the recording medium for forming an image, figure, pattern or the like, or for processing the recording medium.

As described above, according to the present invention, in the ink-jet recording apparatus for recording using an ink-jet recording head capable of discharging ink in varied amounts, processing for maintaining the ink discharge operation, for example, elimination processing for forcibly eliminating ink from the discharge port or recovery processing such as cleaning processing for cleaning the surface on which the discharge port of the ink-jet recording head is provided, or processing for detecting the ink remaining amount of the ink supply source for the ink-jet recording head or the like can be appropriately carried out.

That is, ink dissipation due to excessive ink elimination such as suction can be prevented, and the present invention is very advantageous in terms of ink consumption, thus reducing the running cost. Further, since unnecessary time consumption for suction operation or cleaning operation such as wiping can be prevented, recording throughput is not decreased, and the present invention is advantageous in terms of durability of the recording head and wiping member. Still further, since exact ink remaining amount detection can be performed, the present invention is advantageous also in view of user interface.

The above and other objects, effects, features and advantages of the present invention will become more apparent from the following description of embodiments thereof taken in conjunction with the accompanying drawings.

BRIEF DESCRIPTION OF THE DRAWINGS

FIG. 13 is a diagram for explaining data in a 2-bit decode table;

DETAILED DESCRIPTION OF PREFERRED EMBODIMENTS

In the following, the present invention will be described in detail with reference to the drawings.

First Embodiment

Figure 1:
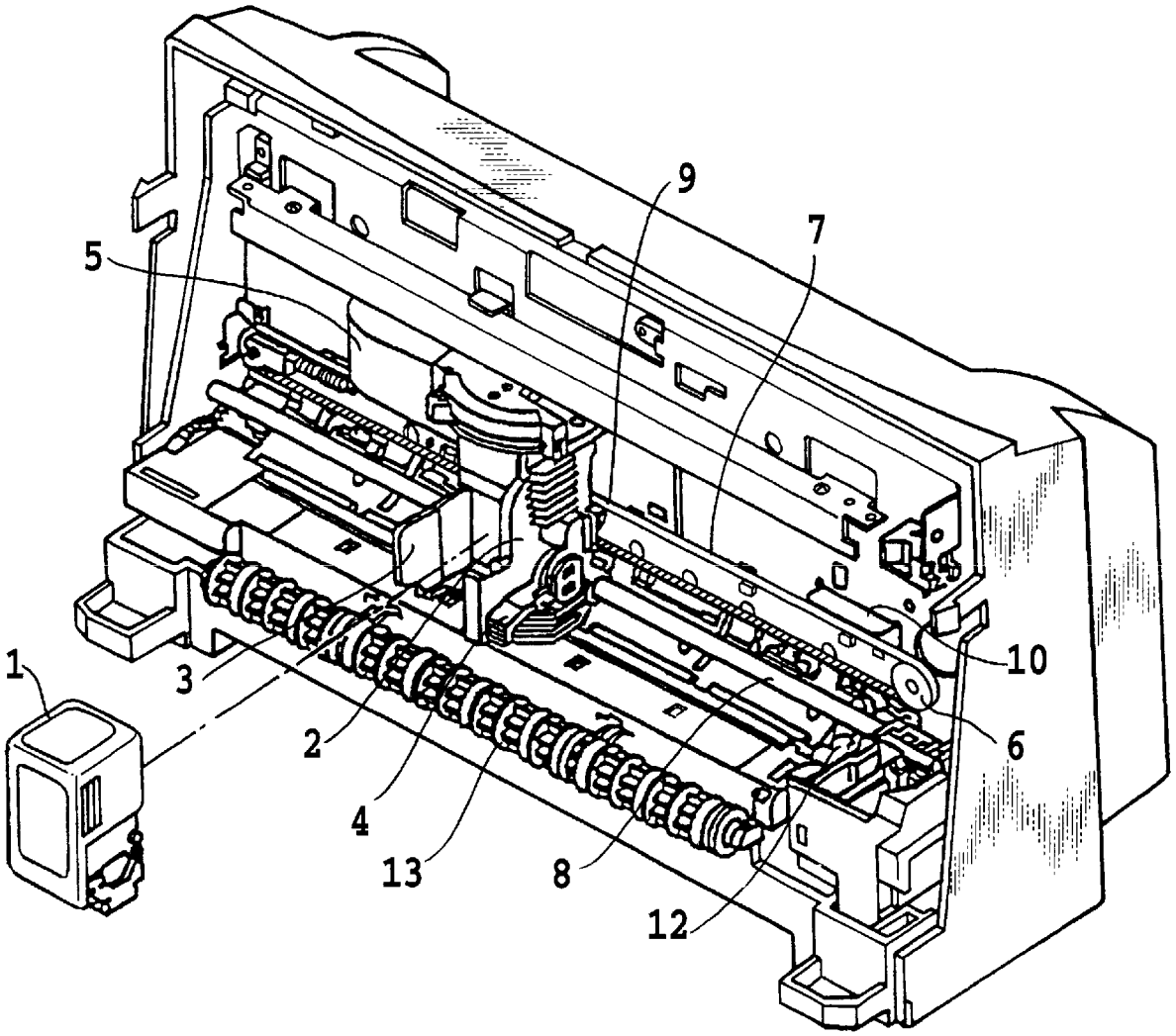
FIG. 1 is a schematic perspective illustration showing a construction example of a recording part of a printing apparatus according to an embodiment of the present invention.

FIG. 1 illustrates a mechanical construction example of a cartridge replacement type ink-jet recording apparatus as a recording apparatus applicable to a first embodiment of the present invention, showing a state with a front cover of the ink-jet recording apparatus removed so that the apparatus construction is visible.

In the Figure, numeral 1 indicates a head cartridge, and 2 is a carriage unit for detachably holding the head cartridge 1. Numeral 3 is a holder for fixing the head cartridge 1 to the unit 2, which operates in cooperation with a cartridge fixing lever 4. That is, after the head cartridge 1 is mounted in the carriage unit 2, the cartridge fixing lever 4 is operated to press the head cartridge 1 against the carriage unit 2. By this pressing, positioning of the head cartridge 1 and electrical contact between an electrical contact at the cartridge 1 side and an electrical contact for necessary signal transmission provided on the carriage unit 2 are obtained. Numeral 5 is a flexible cable for sending an electrical signal to the carriage unit 2.

Numeral 6 is a carriage motor for reciprocally moving the carriage unit 2 in a main scanning direction. Numeral 7 is a carriage belt which is driven by the carriage motor 6 to move (main scan) the carriage unit 2. Numeral 8 is a guide shaft for supporting the carriage unit 2. Numeral 9 is a home position sensor, which is provided with a photocoupler for determining a home position of the carriage unit 2. Numeral 10 is a light blocking plate provided in the vicinity of the carriage home position, with which reaching of the carriage unit 2 at the home position is detected. Numeral 12 is a home position unit including a head recovery system. The head recovery system includes a capping unit for preventing drying of an ink discharge port of the head, a pump unit for performing suction recovery for removing a stain of the ink discharge port and a stain in the recording head, a wiping unit for removing a stain and the like on an ink discharge port formation surface (face), and a waste ink section for storing waste ink discharged by previous discharging performed in the process of the recovery operation. Numeral 13 is a paper delivery roller for delivering a recording medium, which cooperates with a spur roller (not shown) to transport the recording medium to outside of the recording apparatus.

Figures 2A, 2B:
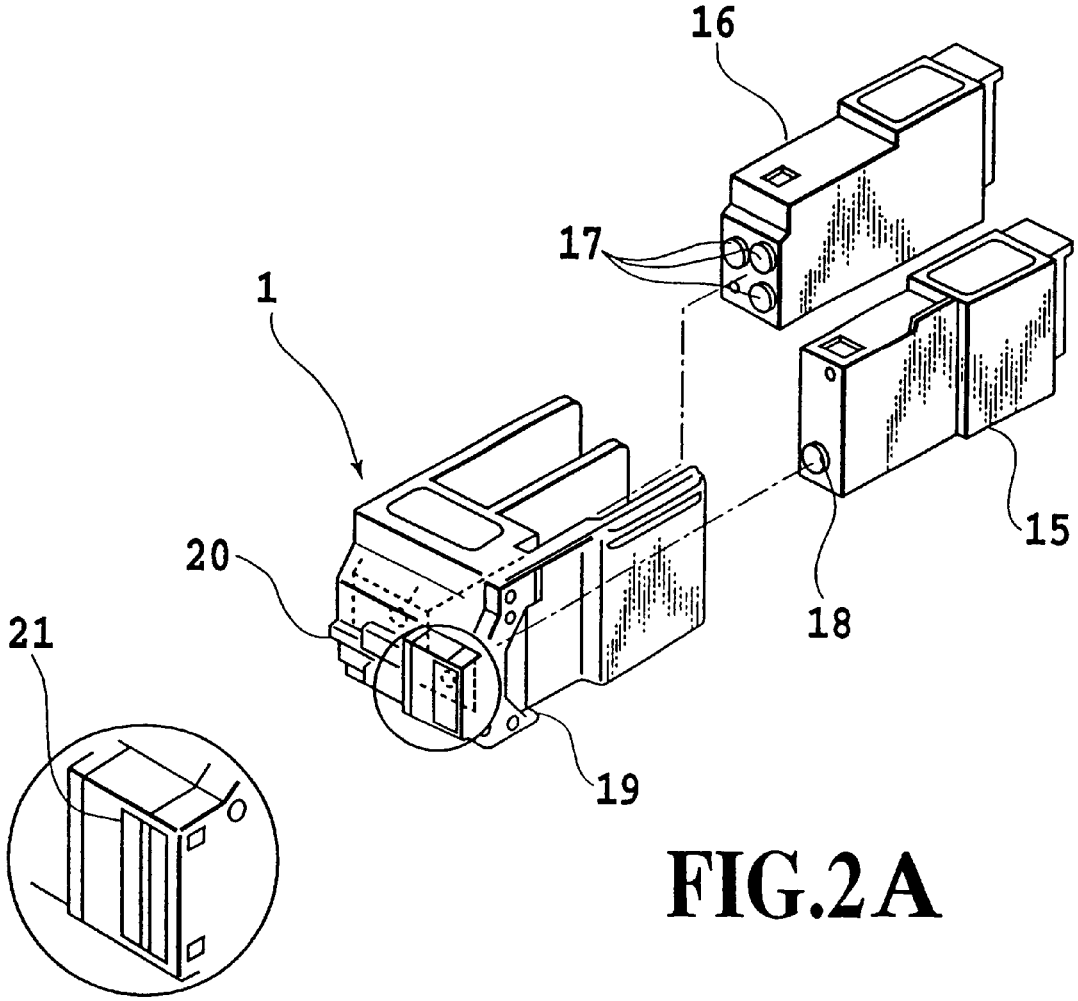
FIG. 2A is a perspective diagram showing the structure of a head cartridge according to the present embodiment and FIG. 2B is a partial enlargement thereof.

FIG. 2A is a detailed diagram of the head cartridge 1 used in the apparatus in FIG. 1 and FIG. 2B is a partial enlargement thereof.

Numeral 15 is a replacement type ink tank as an ink vessel containing a black (Bk) ink. Numeral 16 is a replacement type ink tank containing respective color inks of cyan, magenta, and yellow (hereinafter referred to as C, M, and Y, respectively). Numeral 17 is a connection port of the ink tank 16, which is a portion connected to the head cartridge 1 to supply ink. Numeral 18 is an ink supply port of an ink tank 15. These ink supply ports 17 and 18 are connected with supply tubes at the main unit side of the head cartridge 1 to supply ink to a recording head 21. Numeral 19 is a contact for electrical signals, and is connected with the above flexible cable 5 to transmit signals corresponding to recording data to the recording head 21.

Next, construction of a control system for performing recording control of the above apparatus will be described.

Figure 3:
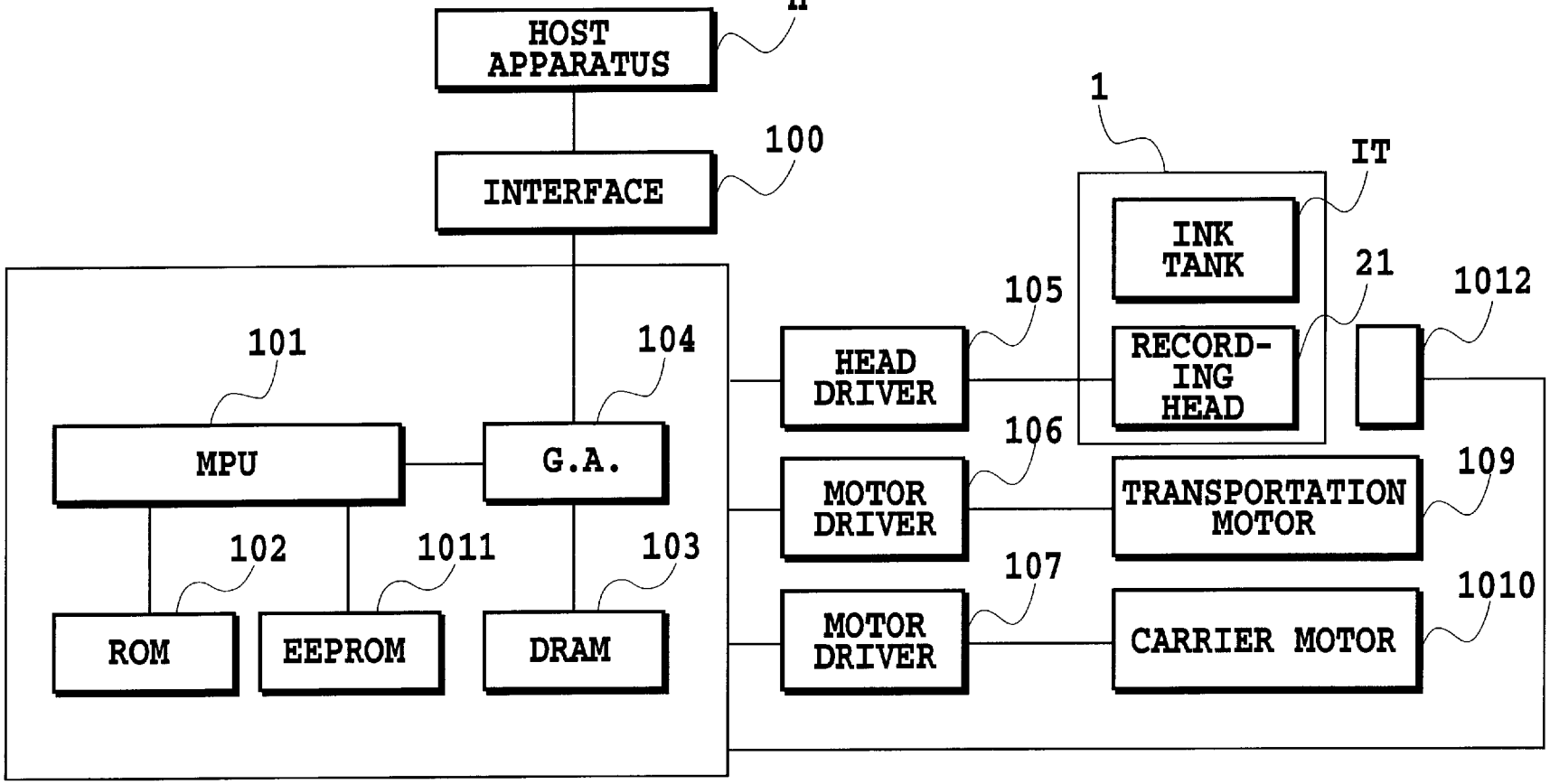
FIG. 3 is a block diagram showing a construction example of a control circuit of the apparatus in FIG. 1.

FIG. 3 is a block diagram showing the construction of a control circuit of an ink-jet printer. In the figure showing the control circuit, numeral 100 indicates an interface provided for inputting image data and control signals relating to recording from a computer, reader or other host apparatus and performing communication of necessary signals, 101 is an MPU, 102 is a ROM storing a control program executed by the MPU 101, and 103 is a DRAM for storing various data (above recording data and recording data and the like supplied to the head). Numeral 104 is a gate array for performing supply control of recording data to the recording head 21, and also performing data transfer control among the interface 100, the MPU 101, and the DRAM 103. Numeral 1010 is a carrier motor for transporting the ink cartridge incorporated with the recording head by the carriage unit 2 to effect main scanning, and 109 is a transportation motor for transportation of recording paper (sub scanning). Numeral 105 is a head driver for driving the recording head. Further, 1011 is an EEPROM for storing necessary information for suction operation control which will be described later, even when the printer power is cut off.

Operation of the above construction of a control circuit will be described. When a recording signal is inputted in the interface 100, the recording signal is converted into recording data between the gate array 104 and the MPU 101. Then, the motor drivers 106 and 107 are driven, and the recording head 21 is driven according to the recording data sent to the head driver 105 to effect recording.

Further, the control circuit controls timing for performing suction recovery operation by a suction unit 1012. The recording head 21 of the present embodiment is provided with a plurality of nozzles for discharging ink arranged in the transportation direction of the recording paper P. Each one of ink droplets discharged from each nozzle corresponds to one pixel (dot) in the image formation.

Figure 4:
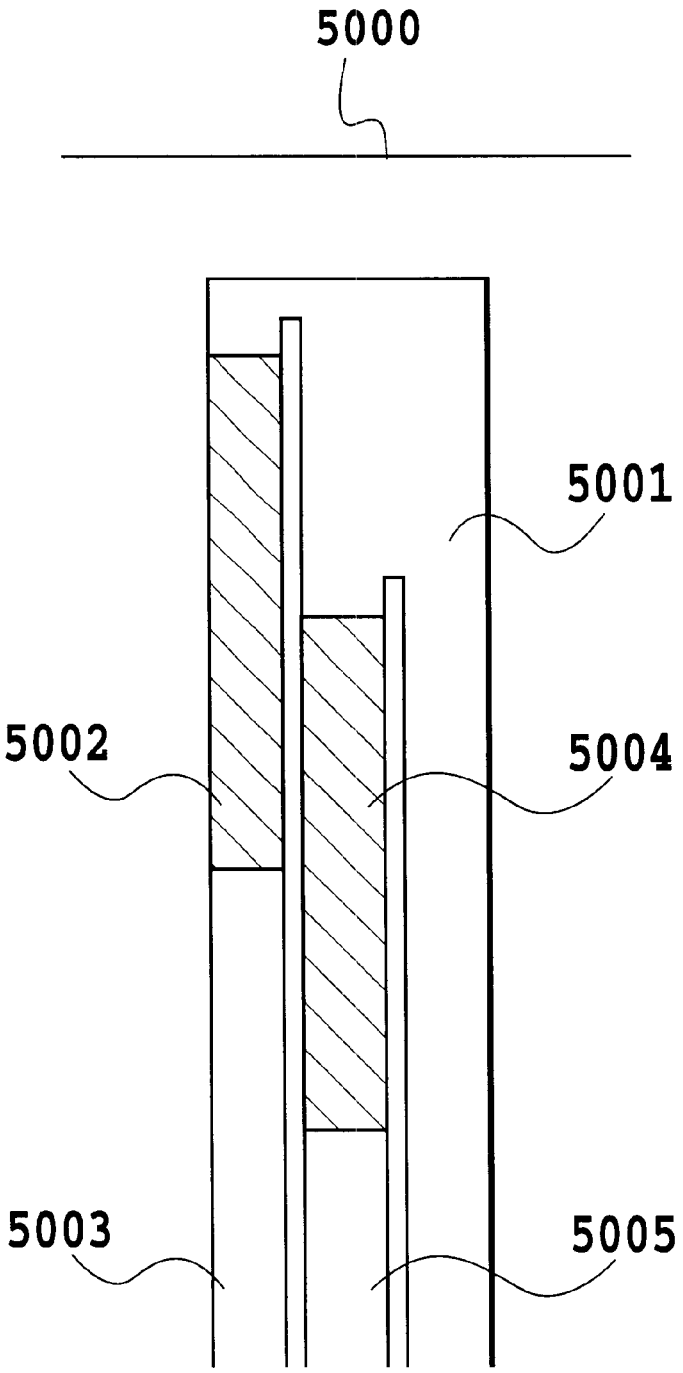
FIG. 4 is a schematic diagram showing a construction example of a discharge heater part in a recording head used in the present embodiment.

FIG. 4 is an enlarged diagram showing a construction example of a discharge heater part which can change the discharged ink amount. The figure shows a construction of the discharge heater part corresponding to one nozzle. Here, numeral 5000 is a side surface of a heater board, which side surface is the ink discharge port side with respect to the discharge heater. In the example shown, the discharge heater part has two discharge heaters 5002 and 5004. Nozzles are formed on the discharge heaters, and two discharge heaters are selectively driven, thereby permitting ink to be discharged from ejection ports at the tip ends of the nozzles. FIG. 4 shows only a construction of one discharge heater part. A plurality of the discharge heater parts are arranged along the horizontal direction of FIG. 4, and the nozzles are formed corresponding to a plurality of discharge heaters, respectively. Here, for example, it is assumed that the size of the discharge heater 5002 disposed at the front side in the discharge direction is larger than the size of the discharge heater 5004 disposed at the rear side. Numeral 5001 denotes a common wiring to the respective heaters, which is connected to a ground line. Numerals 5003 and 5005 are discrete wirings for driving the heaters 5002 and 5004, respectively, in a selected order, which are connected to the heater drivers for turning on and off the power to the heaters.

By providing the two discharge heaters 5002 and 5004 in a single discharge port, when a fine print is required, the rear side heater 5004 is driven to generate a bubble only at the corresponding position so that printing can be performed with a relatively reduced discharge amount to achieve high resolution. On the other hand, when making a so-called "overall" printing, the front side heater 5002 (or both heaters may be used) is driven to generate a relatively large bubble covering a large area so that printing can be performed with an ink dot of a relatively increased discharge amount to improve printing efficiency.

In the construction of the discharge heater part shown in FIG. 4, two discharge heaters 5002 and 5004 are disposed at shifted positions along vertical and horizontal directions of the figure; however, the present invention is not limited to the construction of the discharge heater part shown in FIG. 4. For example, there may be provided a construction in which a plurality of discharge heaters are disposed in parallel in one nozzle along the horizontal direction (in which a plurality of discharge ports are disposed) or along the vertical direction (in which the ink is discharged). The present invention is sufficiently applicable to a construction in which a discharge amount of ink can be changed stepwise and significantly by applying a driving signal. In particular, the present invention is preferably applicable to a construction in which a plurality of discharge heaters are provided inside of one nozzle, and the plurality of the discharge heaters are selectively driven, thereby making it possible to change an amount of the ink droplets discharged from the nozzle.

Further, as described above, when large ink droplets are discharged, both of the two heaters may be used. Furthermore, the present invention provides a construction in which the number of discharge heaters to be driven in one nozzle is changed according to ink droplet size to be discharged, for example, such construction in which only one heater is driven when the small ink droplets are to be discharged; and two heaters are driven when the large ink droplets are to be discharged.

Figure 5:
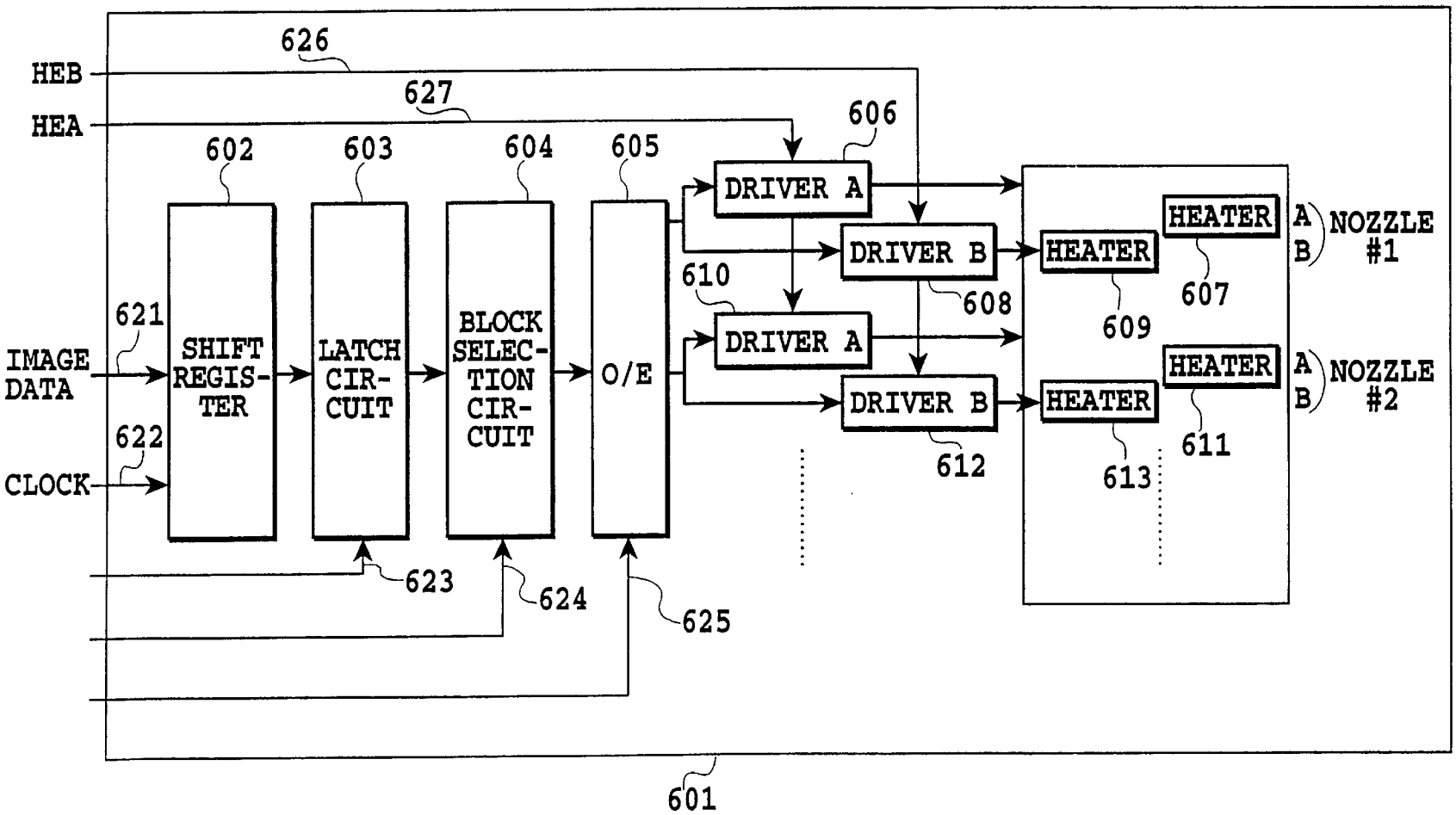
FIG. 5 is a block diagram showing a construction example of a recording head drive circuit of the present embodiment.

FIG. 5 is a diagram showing a signal flow in the head cartridge of the printing apparatus according to the present embodiment. Here, a case will be described in which two heaters (having different heat generation amounts) for discharging ink are provided for a single nozzle as shown in FIG. 4, and a driven heater is controlled thereby to change the discharged ink amount (recorded dot size) for recording.

In FIG. 5, numeral 601 indicates a discharge heater driving device of the recording head, and image data 621 to be recorded is sent to the discharge heater driving device 601 serially from the printer apparatus main unit in synchronization with a clock register 622. The serial data is transferred to a shift register 602 and held there. When all of the serial data to be recorded in a single recording timing is transferred to the shift register 602, a latch signal 623 is outputted from the main unit of the printing apparatus, and the data held in the shift register 602 is latched in a latch circuit 603 in synchronization with the latch signal 623. Output of the latch circuit 603 is selectively outputted to respective heater drivers according to a block selection signal 624. Numeral 605 is an odd/even selector which selects whether an odd numbered nozzle of the recording head or an even numbered nozzle of the recording head is to be driven.

In this case, as an example of the circuit construction of the recording head used in the present embodiment, two discharge heaters A and B for large dot and small dot are disposed with a single nozzle, and when an ink discharge amount from each nozzle is selected, either of the heaters A, B is selected. As another example, a plurality of heat generation resistors are provided within a single nozzle, and the number of heat generation resistors driven nearly simultaneously among these plurality of heat generation resistors may be changed.

In the present embodiment, the shift register 602 and the latch circuit 603 have a number of bits equal to the number of nozzles, data corresponding to the large dots and small dots recorded in a first one period is held in the shift register 602 and the latch circuit 603, then the data corresponding to the large and small dots recorded in a second period is similarly held in the shift register 602 and the latch circuit 603, and recording of one line of head nozzle is performed in two periods; however, alternatively, the shift register 602 and the latch circuit 603 may be those which can hold a number of bits two times (when one pixel is composed of two bits) the number of nozzles.

According to the above construction, various methods can be considered as a method for controlling the size of a dot to be recorded. However, here, for example, with a nozzle #1 being considered, when a discharge heater A 607 is driven through a driver A 606 by a heat enable signal (HEA) 627, the discharged ink amount from nozzle #1 is increased to form a large dot, and when a discharge heater B 609 is driven through a driver B 608 by a heat enable signal (HEB) 626, ink in a decreased amount is discharged from nozzle #1 to form a small dot. Similarly for a nozzle #2, when a discharge heater A 611 is driven by a driver A 610, a large dot is formed, and when a discharge heater B 613 is driven by a driver B 612, a small dot is formed.

In the above construction, conditions for recording a dot at the designated position on the recording material are as follows.

(1) A bit of recording data corresponding to a discharge nozzle latched in the latch circuit 603 is "1" (data exists).

(2) The nozzle position corresponds to the block selected by a block selection signal 624.

(3) The nozzle position corresponds to a selection signal 625 for selecting an odd numbered nozzle or an even numbered nozzle.

(4) The corresponding heat enable signal 626 or 627 is inputted.

When the above four conditions are simultaneously met, one of the discharge heater A or B of the corresponding nozzle is driven, and a large dot or a small dot is outputted from the nozzle. That is, according to whether the inputted heat enable signal at that time is the signal 626 or the signal 627, the dot diameter of ink droplet discharged from the nozzle is determined, and the disposition of large and small dots is determined according to at what block timing the recording data is high level ("1").

Next, a practical printing example will be described with reference to FIGS. 6 to 8. Here, for simplicity of description, the recording head is assumed to have a single nozzle. In these figures, each grid cross point indicates a dot position to be recorded by the recording head.

Figure 6:
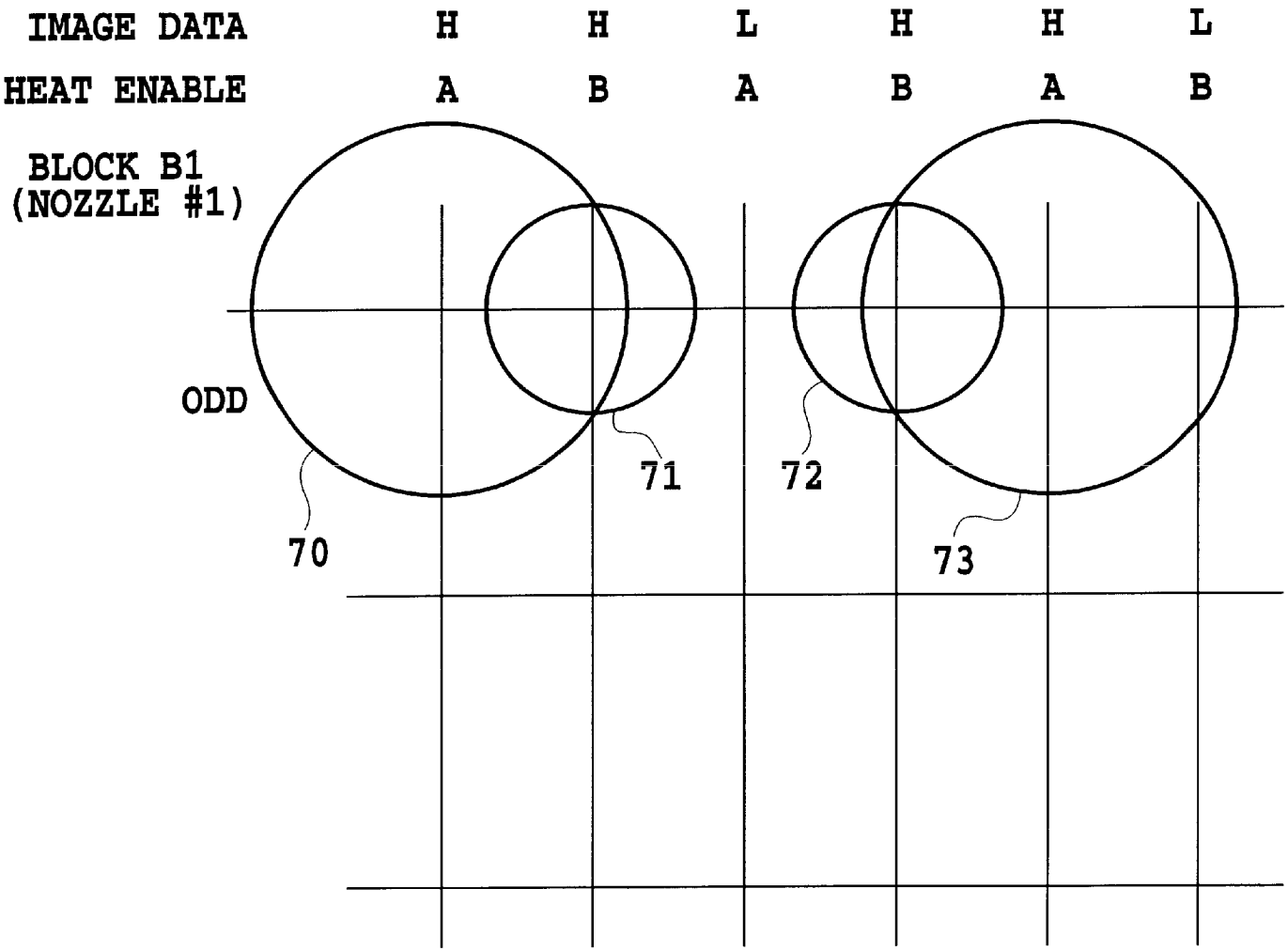
FIG. 6 is a diagram for explaining a formation state of recording dots in the printing apparatus according to the present embodiment.

In FIG. 6, the grid interval in the main scanning direction is 720 dpi (dots/inch). Here, the nozzle #1 is assumed as the nozzle of block B1. Since only one nozzle is present, block selection and odd/even numbered nozzles selection are not performed, and the selection signal 624 for selecting the block B1 and the signal 625 for selecting the odd numbered nozzle are on every time (high level). The part where the data shown by the image data is "H" indicates that the recording data exists, and "L" indicates absence of data. Further, in the heat enable signal, "A" shows that a heat signal for discharge (large dot) is sent to the driver A, and "B" shows that a heat signal for discharge (small dot) is sent to the driver B.

As a result, as shown in FIG. 6, large dots and small dots are mixedly recorded in the same recording scan. That is, by outputting the heat enable signals A and B selectively, large dots 70 and 73 and small dots 71 and 72 are recorded as shown.

Figure 7:
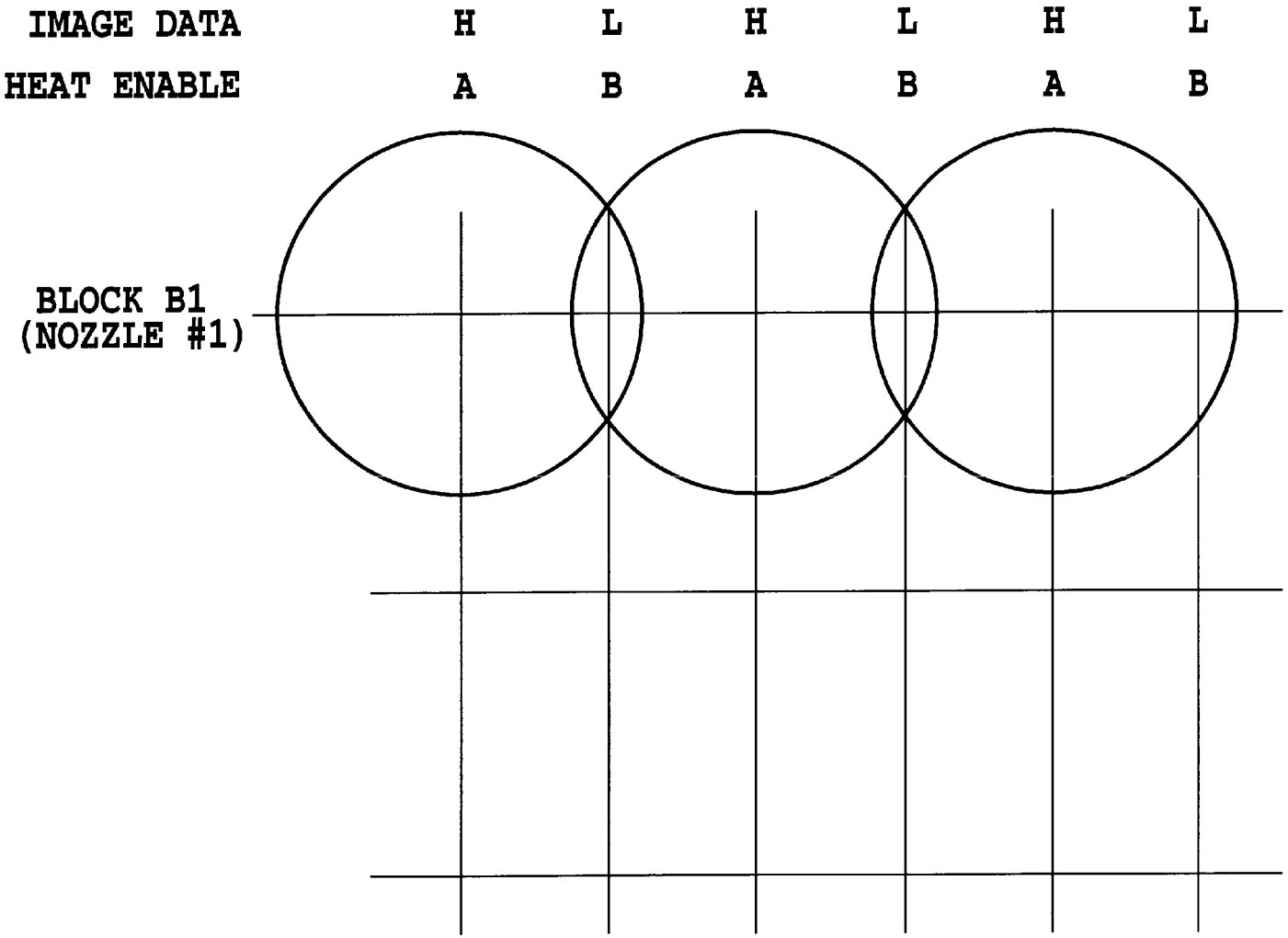
FIG. 7 is a diagram for explaining a formation state of recording dots in the printing apparatus according to the present embodiment.

Further, when only large dots are necessary, as shown in FIG. 7, it is sufficient that the heat enable signal 627 is outputted when the image data corresponding to the nozzle is high level (H), that is, when the data exists.

Figure 8:
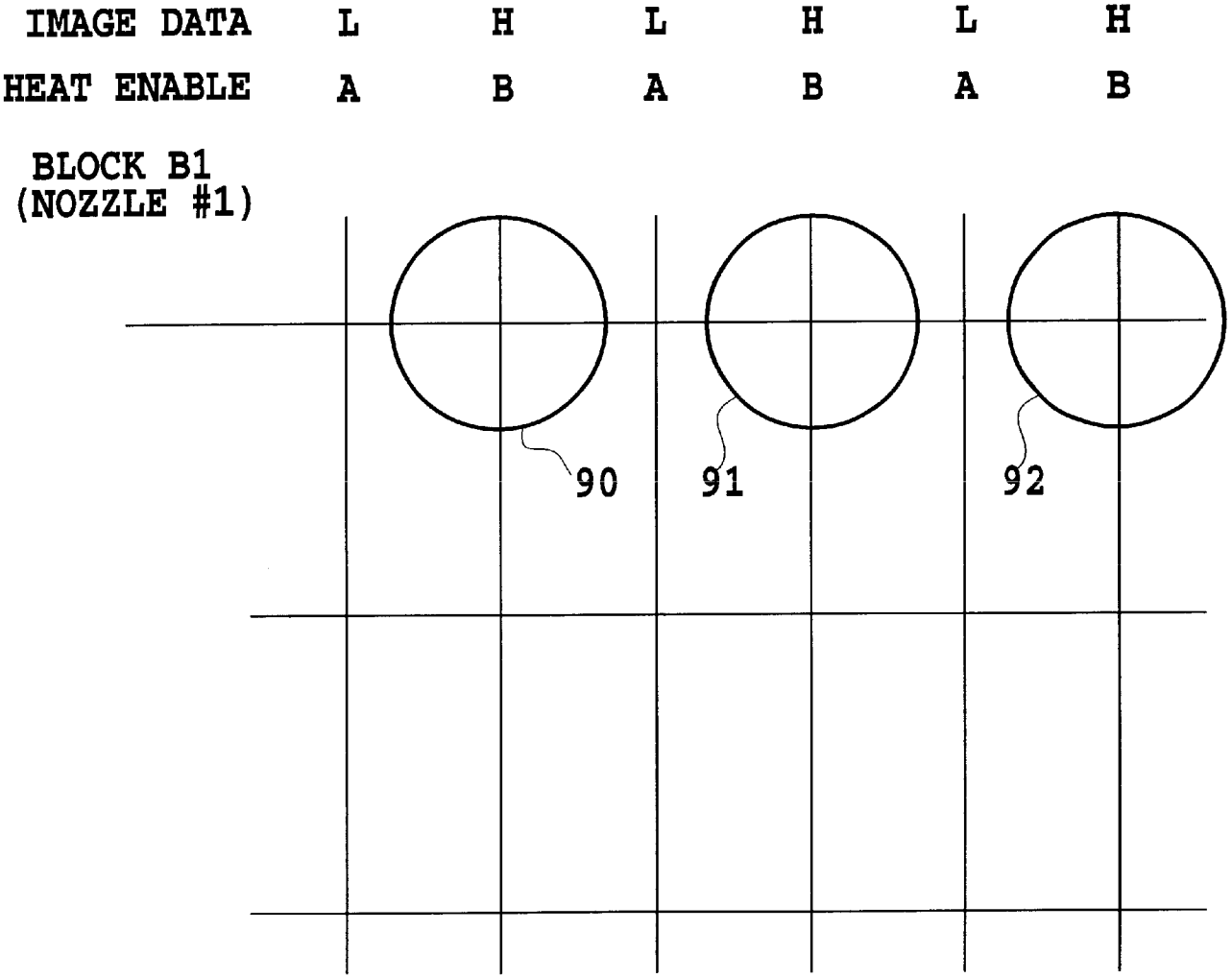
FIG. 8 is a diagram for explaining a formation state of recording dots in the printing apparatus according to the present embodiment.

On the contrary, when only small dots are necessary, as shown in FIG. 8, it is sufficient that the heat enable signal 626 is outputted when the image data corresponding to the nozzle is high level (H), that is, when the image data exists.

Next, a case of using a recording head having a plurality of nozzles for performing recording is described. When the plurality of nozzles are used, a plurality of block selection signals are required as compared with the above-described case of using a single nozzle. In this case, several driving methods can be used. Here, a construction is exemplified in which a set composed of even-numbered and odd-numbered nozzles adjacent to each other is assumed as one block, and the block number is arranged in increasing order.

Figure 9:
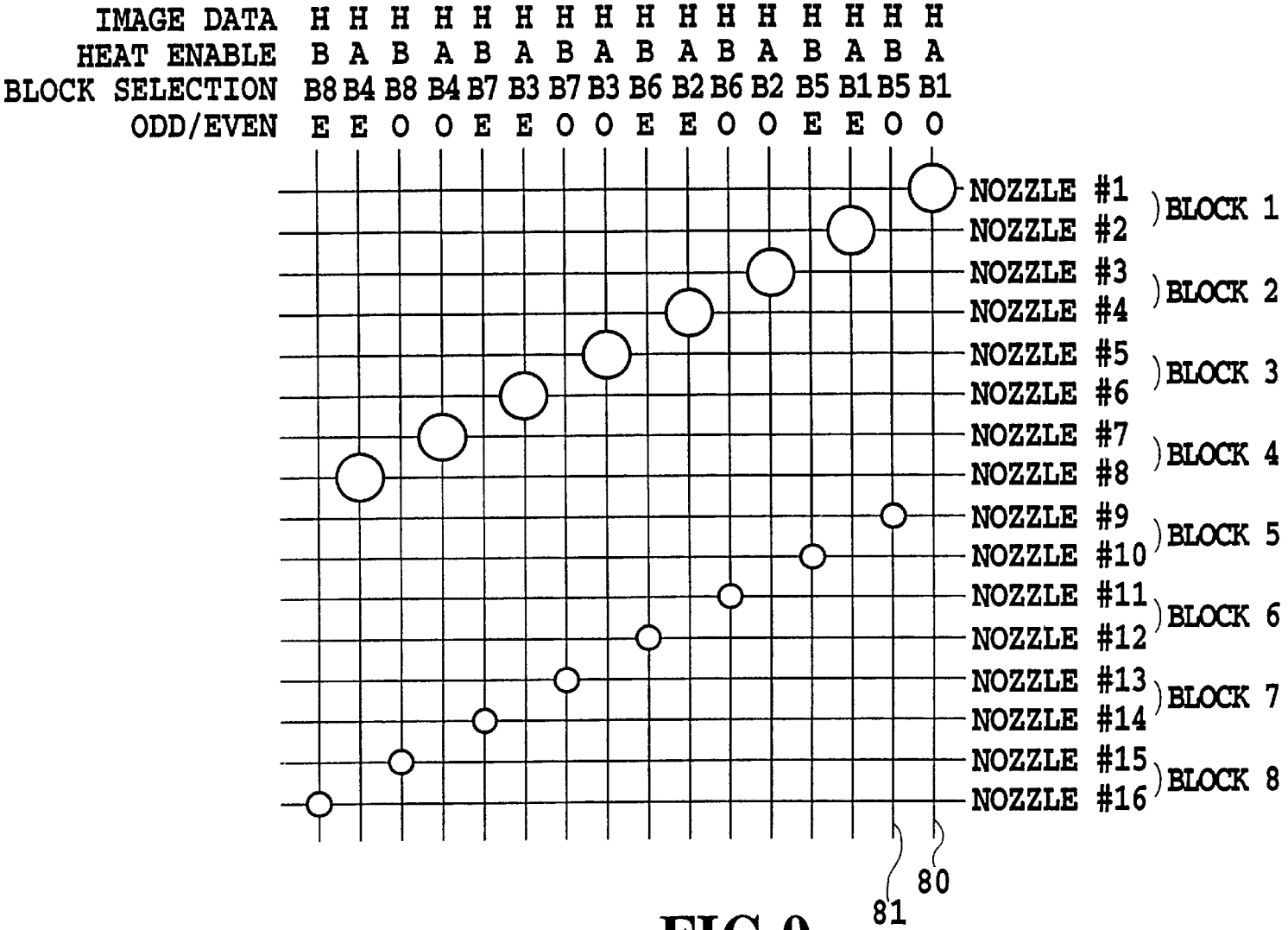
FIG. 9 is a diagram for explaining a formation state of recording dots in the printing apparatus according to the present embodiment.

In this case, a recording head having 16 nozzles and discharge ports arranged inclined to the main scanning direction is exemplified. As shown in FIG. 9, the number of blocks is "8". Here, the nozzle shown as nozzle #1 and the adjacent nozzle (nozzle #2) are assumed as block B1, and the block number is successively increased as 2, 3, 4, . . . 8 as the nozzle number increases. In the example shown in FIG. 9, the nozzles are divided into block 1 (B1) to block 8 (B8). In this state, a nozzle, in which the conditions of four signals of image data being high level ("1"), heat enable signal being on, block selection signal, and odd/even selection signal are met, is driven to discharge ink.

FIG. 9 shows a case in which ink is discharged from all of nozzles #1 to #16 (large dots for nozzles #1 to #8, and small dots for #9 to #16) to record dots.

First, with respect to nozzle #1, when the four signals of image data, heat enable signal, block selection signal (B1), and odd/even selection signal (odd) are all on at timing 80, since the heat enable signal is "A", a drive signal is sent to the driver A connected to the discharge heater A in the nozzle #1 to form a large dot by the nozzle #1. At the next timing 81, with respect to nozzle #9 of block B5 (B5), when four signals of image data, heat enable signal, block selection signal (B5), and odd/even selection signal (odd) are all on, since the heat enable signal is "B", a drive signal is sent to the driver B connected to the discharge heater B in the nozzle #9 to form a small dot by the nozzle #9.

Similar processing is carried out for nozzle #2 of block B1 and nozzle #10 of block B5 until driving is completed up to last nozzle #16 of block 8 to complete recording of large dots of one period and small dots of one period, thus completing recording of a total of two periods.

Figure 10:
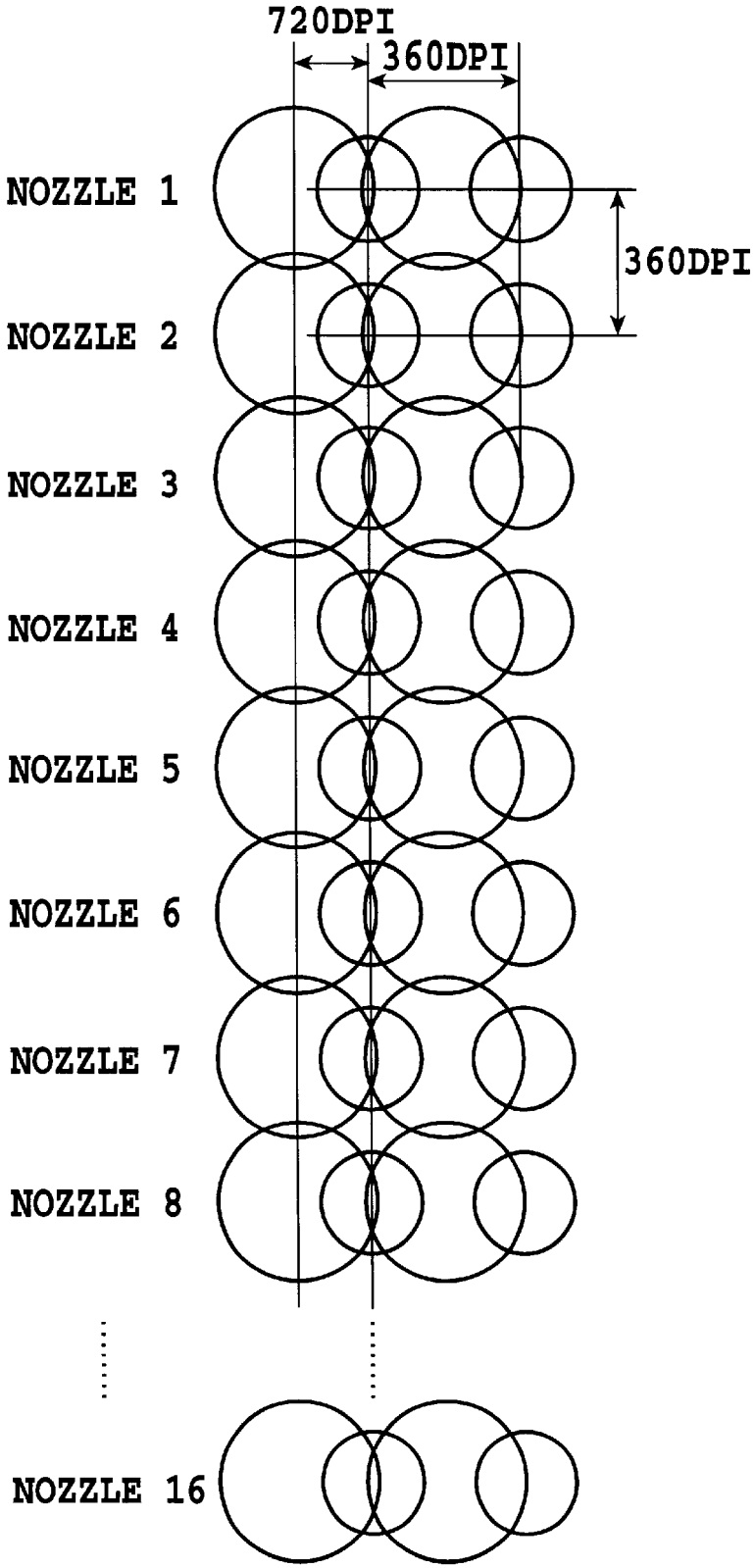
FIG. 10 is a diagram for explaining a formation state of recording dots in the printing apparatus according to the present embodiment.

FIG. 10 shows an example of an image of recording completed by such driving. In FIG. 10, dot positions on the recording material are shown when recording is performed to addresses corresponding to the resolution of 720 dpi×360 dpi according to the discharge timing of each nozzle. FIG. 10 shows a state of two periods of large dots and two periods of small dots recorded using all nozzles.

The discharge ports are arranged to be inclined by an angle corresponding to a discharge timing difference from the nozzle #1 to #16 shown in FIG. 9. Accordingly, even if the above timing difference is produced, as shown in FIG. 10, the printed large and small dots can be arranged in parallel to the form feed direction.

Application of the system for selective printing of large and small dots in an actual printer system will be described.

Figure 11:
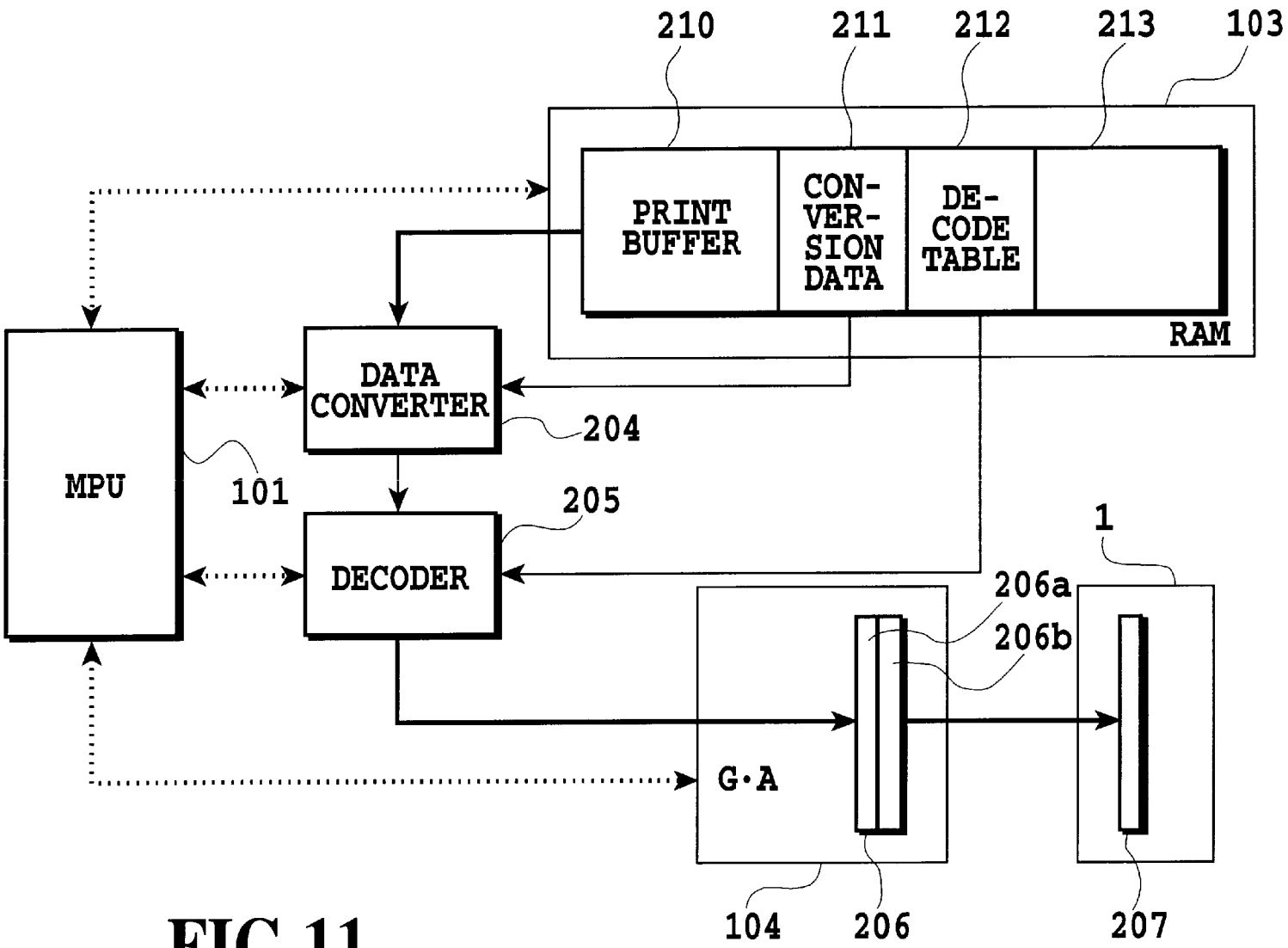
FIG. 11 is a block diagram of a recording data processing circuit in the present embodiment.
Figure 14:
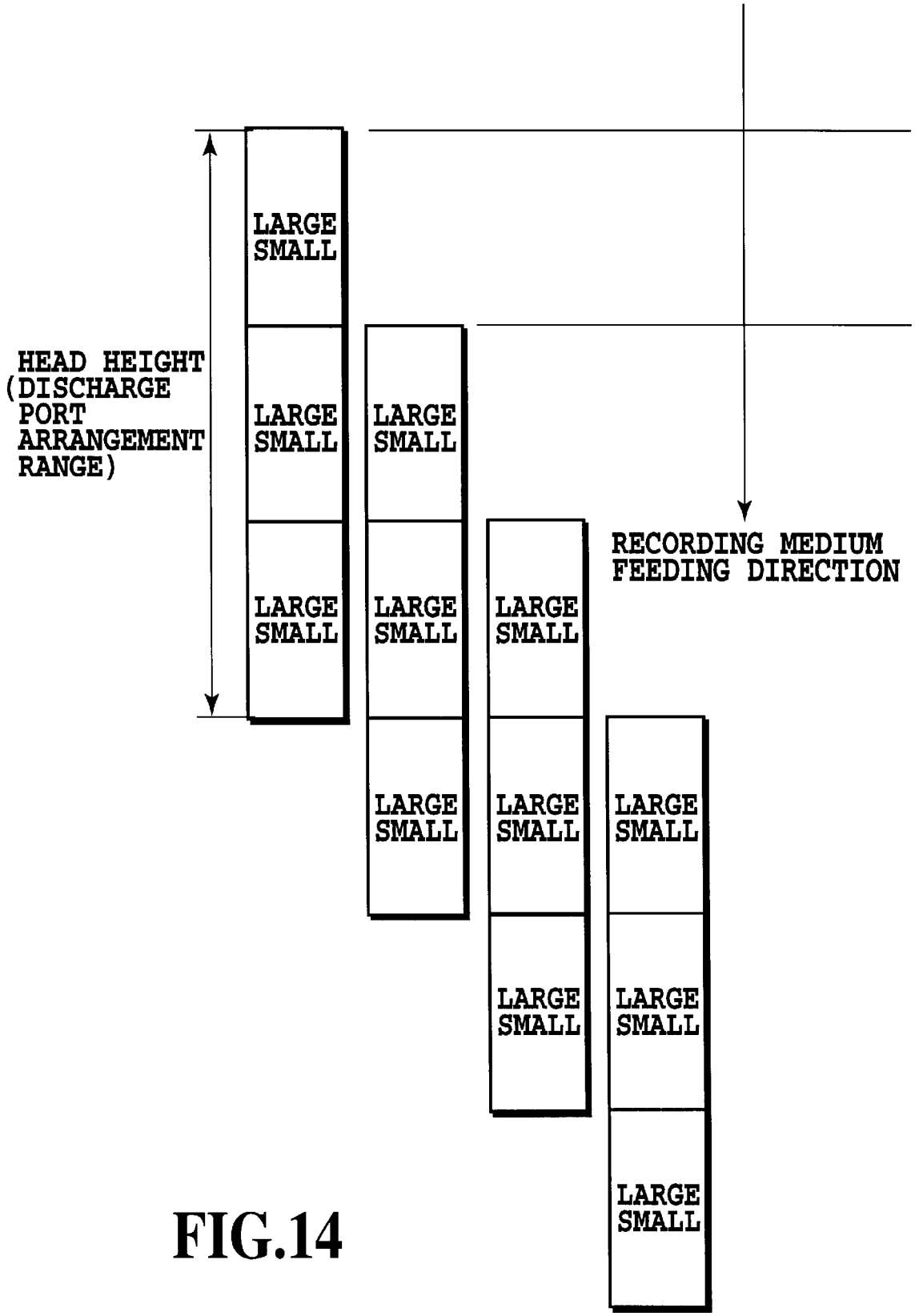
FIG. 14 is a diagram for explaining a multipass recording method.

FIG. 11 is a diagram showing data flow sent from the control part of the printer main unit to the print head 21. Similar components as those used in above-described FIG. 3 have similar reference numerals, and detailed description thereof is omitted. Further, FIG. 11 shows signal flows only for the parts related to the object of the present embodiment. A RAM 103 has a print buffer 210 storing the print data, a conversion data storage area 211 for converting the pixel (print) data, a decode table 212, a work area 213 and the like. In the print data stored in the print buffer 210, each pixel comprises two bits, and G. A. (gate array) 104 reads the print data stored in the print buffer 210 by direct memory access (DMA). Here, from the print buffer 210, normally, data is read in multiples of words (16 bits). Therefore, in the data arrangement shown in FIG. 12, data corresponding to an area surrounded by the thick lines is read as 2-bit data/pixel by the G. A. 104. Numeral 204 is a data converter for converting pixel data according to conversion data, for dividing data of each recording pass in a so-called multipass recording as shown in FIG. 14. Numeral 205 is a decoder, which decodes (modulates) 2-bit print data according to the data table (modulation data) stored in a decode table 212. Numeral 206 is a register for the G. A. 104, and has a register 206*a* for storing large dot formation data and a register 206*b* for storing small dot formation data.

Figure 12:
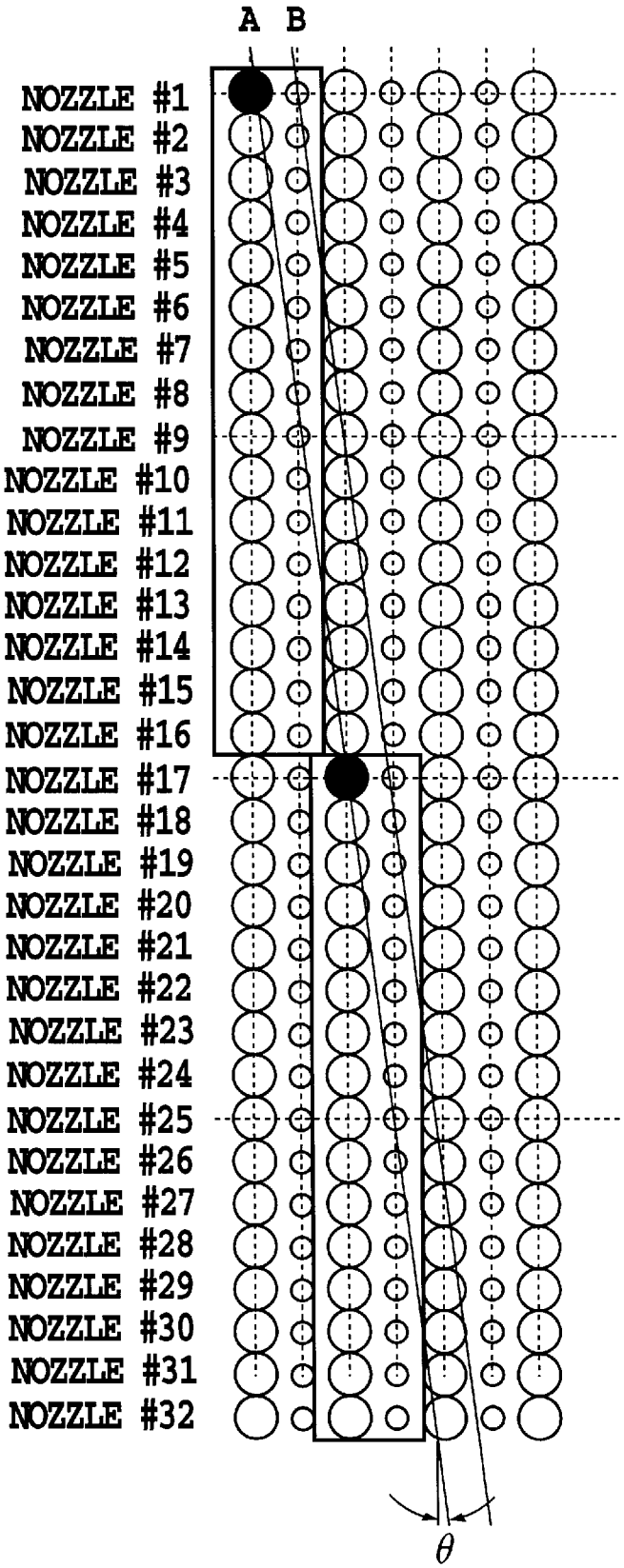
FIG. 12 is a diagram for explaining simultaneously formed dots and transferred recording data.

FIG. 12 shows part (only 32 nozzles) of a recording head, for example, having 256 nozzles. In this head the discharge ports are arranged to be inclined by a predetermined angle θ with respect to the recording medium feed direction as described previously.

Referring to FIG. 12, in the first period, two of the nozzles are simultaneously driven to discharge ink in the following manner: large dots of nozzle #1 and nozzle #17, then, small dots of nozzle #9 and nozzle #25, next, large dots of nozzle #2 and nozzle #18, next, small dots of nozzle #10 and nozzle #26. In the second period, in the manner of small dots of nozzle #1 and nozzle #17, then, large dots of nozzle #9 and nozzle #25, next, small dots of nozzle #2 and nozzle #18, ink is discharged simultaneously from two the of the nozzles to record an image of a total of 32 pixels. In the third period, in the same manner as in the first period with large dots of nozzle #1 and nozzle #17, then, small dots of nozzle #9 and nozzle #25, next, large dots of nozzle #2 and nozzle #18, two of the nozzles are simultaneously driven to perform recording. The example of FIG. 12 shows a case in which all nozzles form large dots and small dots. For each nozzle, presence or absence of formation of a large dot and a small dot is specified by 2-bit print data, and a case in which both are formed is specified as "11".

In the present embodiment, in order to express gradation by a combination of two dots using 2-bit print data, when the print data is read from the print buffer 210 to store in the register 206 of the G. A. 104, the data is converted by the decoders 204 and 205 and stored. At this moment, several methods can be considered for the case of 1-pass recording and multipass recording. First will be described an embodiment of 1-pass recording in which recording is performed while effecting subscanning of a length corresponding to the discharge port arrangement area.

FIG. 13 is a diagram showing an example of decoding by the decoder 205 of print data in which each pixel read from the print buffer 210 is represented by two bits.

In the printing apparatus of the present embodiment, quadrated (each pixel represented by 2 bits) data outputted from the printer driver of a host computer is received, and is written in the print buffer 210. Next, the 2-bit data of the print buffer 210 is DMA transferred to the register 206 of the G. A. 104 while decoding the print data by the 2-bit decoder 205 according to a correspondence rule (contents stored in the decode table 212) as shown in FIG. 13. At this moment, in the case of 1-pass recording, the print data is passed, as is, through the multi-converter 204. In the example of FIG. 13, a decode output for forming a large dot and a small dot is allocated to 2-bit input print data "10", and a decode output forming only a small dot is allocated to print data "01", and by changing the contents of the decode table 212, an optional decode output can be obtained for a 2-bit data from the decoder 205.

Next, a case of multipass recording is shown. In the case of multipass recording, as shown in FIG. 14, the recording medium feed quantity is set to 1/n of the discharge port arrangement range to be used (n=3 in an example of FIG. 14), and is recorded by n-times with complementarily decimated data to 1/n during main scanning. Then, a one-raster line is recorded using nozzles of 'n' in number.

In FIG. 14, at each recording scan, the recording medium is fed by a length corresponding to ⅓ of the discharge port arrangement area, and recording (1 band) is performed by three passes. In the prior art recording method, when recording of a thinned image is completed in each recording scan in the main scanning direction, the recording medium is fed in the subscanning direction, and further recording in the main scanning direction is performed to make complementary recording of the image part thinned in the previous main recording scan, thereby completing image recording. In the present embodiment, 2-bit data is outputted as above for each main scan recording, and a further decoding function is added to the prior art thinning (dot reducing) function (here, data conversion) to increase the gradation latitude.

This function will be described with reference to FIGS. 15 to 22.

Figure 16:
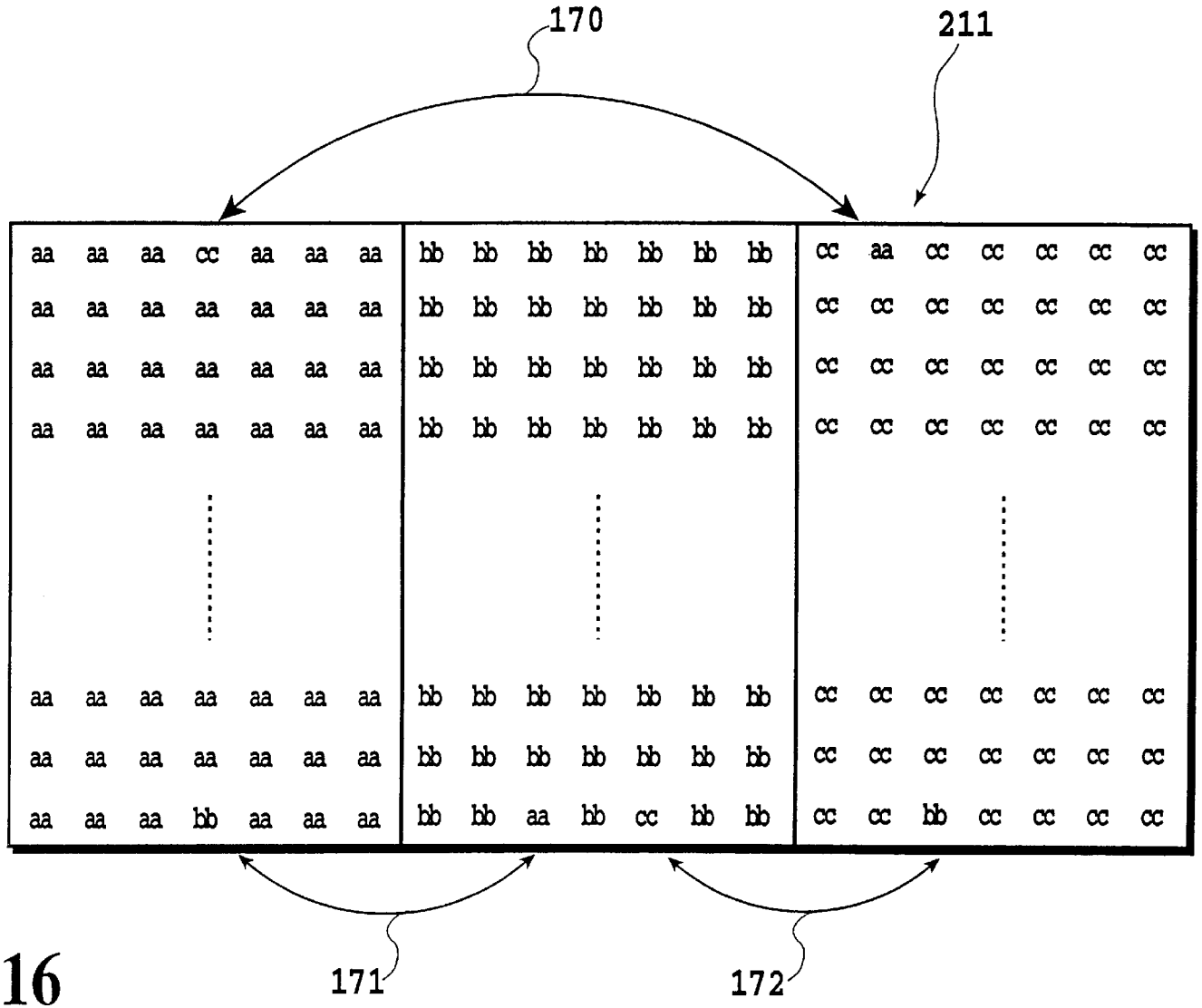
FIG. 16 is a diagram for explaining preparation of a random mask for performing multipass recording.

In the present embodiment, since the print data expresses gradation by two bits, thinning (data conversion) data is formed by a combination of two bits and stored in a conversion data area 211 of the RAM 103. As a formation method of this data, for example, in a case of performing recording by three passes, three sets of 2-bit data (aa (for the first recording pass), bb (for the second recording pass), and cc (for the third recording pass)) are allocated to be uniform numbers in the memory area 211 as shown in FIG. 16.

Figure 15:
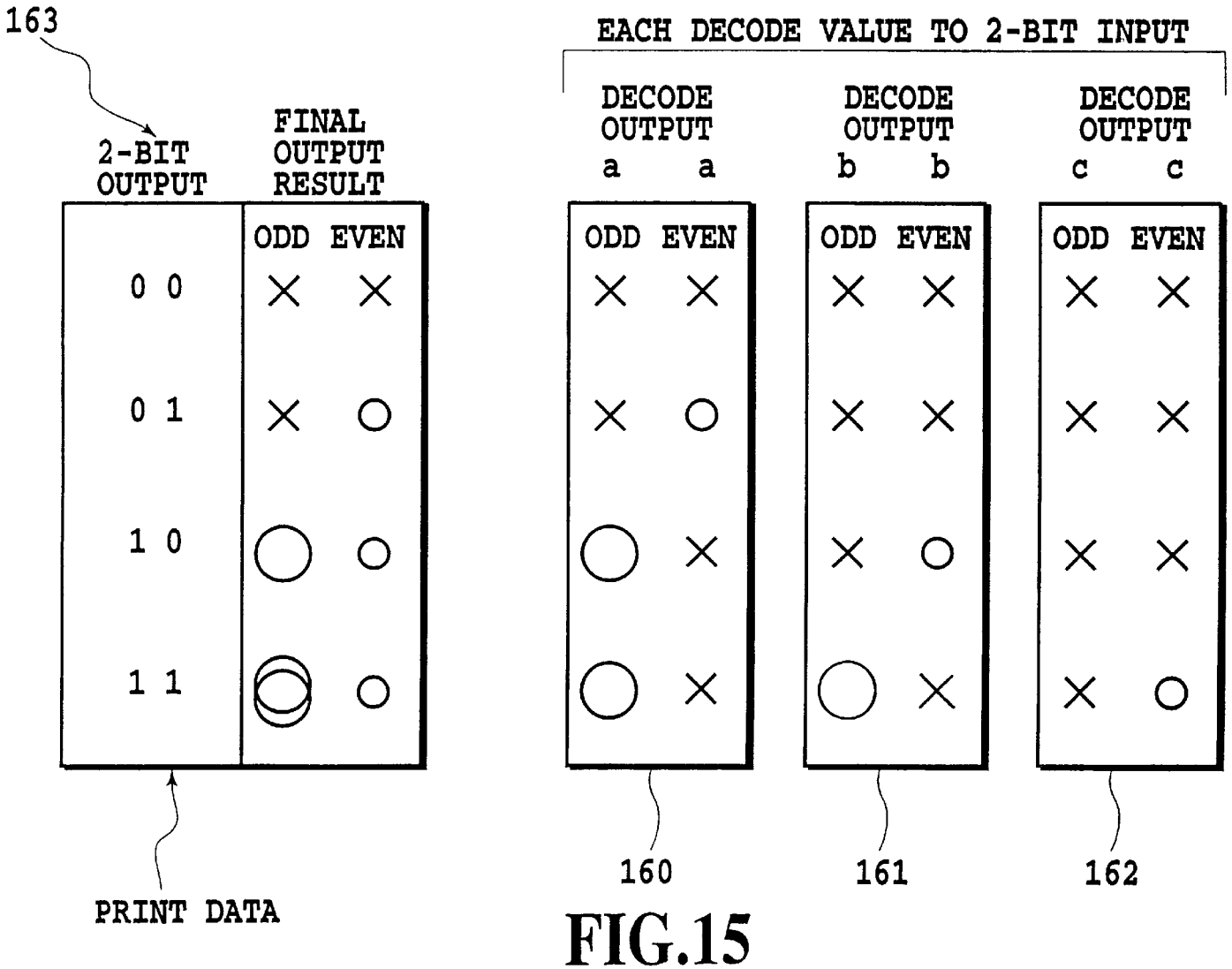
FIG. 15 is a diagram showing data in the 2-bit decode table for performing multipass recording.

Next, the three sets of 2-bit data are shuffled convertingly. By repeating the conversion shuffling more than a predetermined number of times, as shown by 170, 171, and 172 in FIG. 16, a random number table randomly containing the three sets of data is completed. The thus formed data is stored in the conversion data area 211 of FIG. 11. In 3-pass recording, for recording data of each recording scan, the print data is converted by the data converter circuit 204 according to the conversion data. FIG. 15 shows this example.

In FIG. 15, the decode output indicated by numeral 160 shows an example in which the print data (2 bits) is converted by data "aa" and further converted by the decoder 205 according to the contents of the decode table 212, the decode output indicated by numeral 161 shows an example in which the print data is converted by data "bb" and further converted by the decoder 205 according to the contents of the decode table 212, and the decode output indicated by numeral 162 shows an example in which the print data is converted by data "cc" and further converted by the decoder 205 according to the contents of the decode table 212. Table 163 shows a resulting print example of print data by three recording scans.

In the example of FIG. 15, print data "00" shows a state of no recording dot, print data "01" shows a state of minimum density where only one small dot is recorded by 3-pass recording, print data "10" shows a state where one each of a large dot and a small dot are formed, print data "11" shows a state where two large dots are printed overlappingly and a further one small dot is recorded, respectively. It is needless to say that FIG. 15 illustrates only an example, and is not intended to be limitative of the present invention.

That is, it is possible to select any one of combinations of four types of final output results from a plurality of combinations, by changing the contents of the decode table 212 of the RAM 103.

Figure 17:
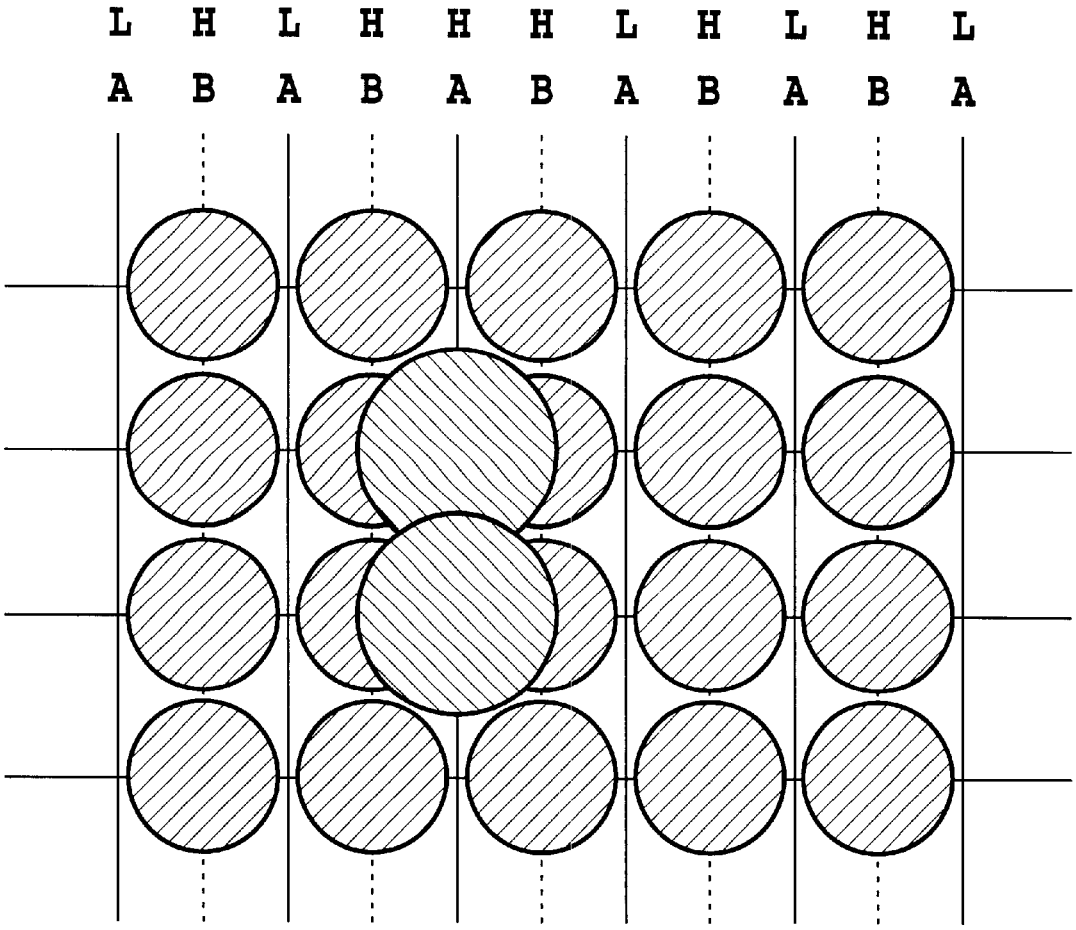
FIG. 17 is a diagram showing a print example by the present embodiment.
Figure 17:
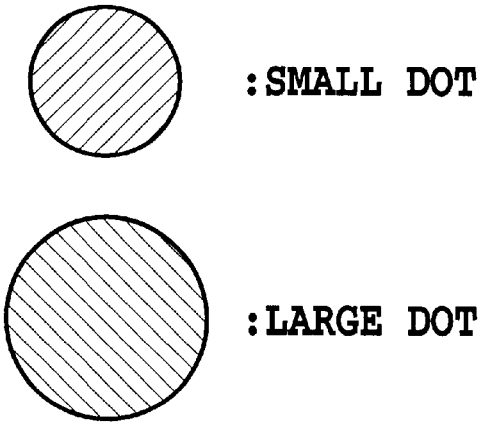
Figure 18:
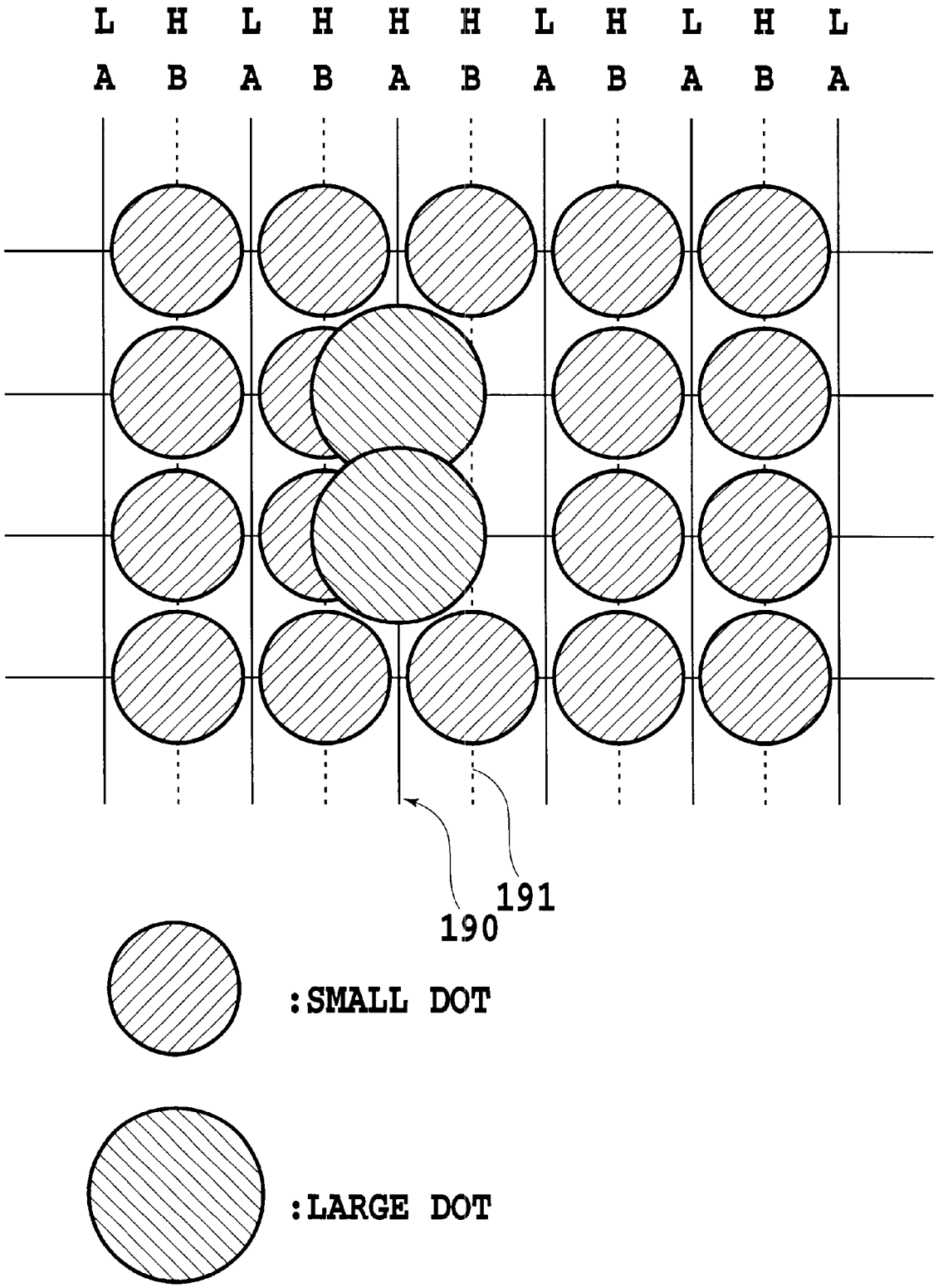
FIG. 18 is a diagram for explaining a problem when the printing method according to the present embodiment is not performed.

By the above method, after recording with a small dot, when the density is further increased and a large dot is recorded, as shown in FIG. 10, a small dot and a large dot appear as a pair at different recording positions. By utilizing this, as shown in FIG. 17, for example, by recording a large dot between dots recorded with small dot, it becomes possible to record so that no space is present between adjacent small dots. On the contrary, FIG. 18 shows a case where a large dot is disposed at the position indicated by numeral 190, no small dot is disposed at adjacent position 191, and, in this case, a space is generated at the right side of the large dot.

Then, in the present embodiment, when gradation is expressed using sub-pixels (large and small dots), even when 2-bit input as shown in FIG. 15 is "10", one each of a large dot and a small dot are recorded to suppress generation of a space of image by omission of a small dot as shown in FIG. 17.

Figure 19:
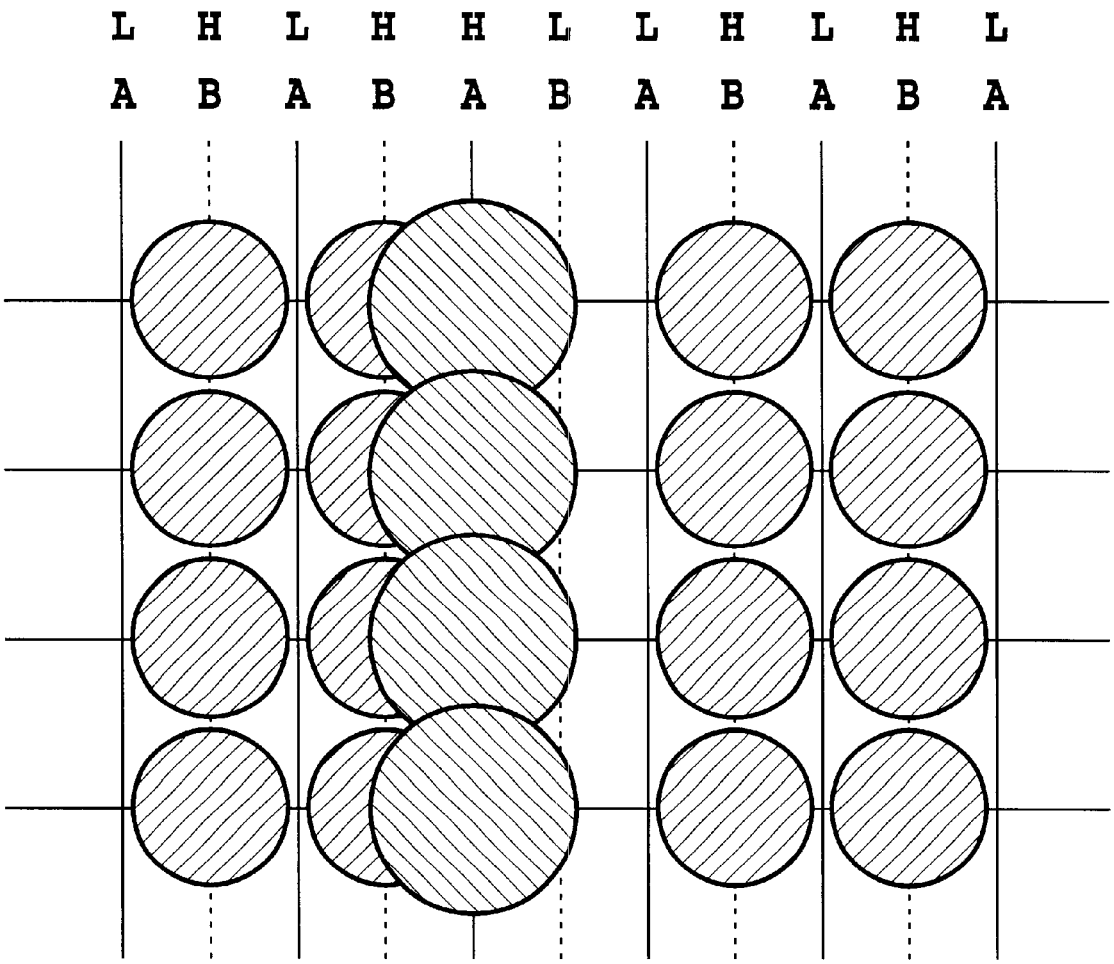
FIG. 19 is a diagram for explaining a problem when the printing method according to the present embodiment is not performed.
Figure 19:
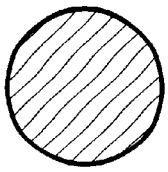
Figure 19:
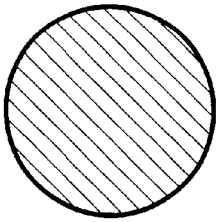
Figure 20:
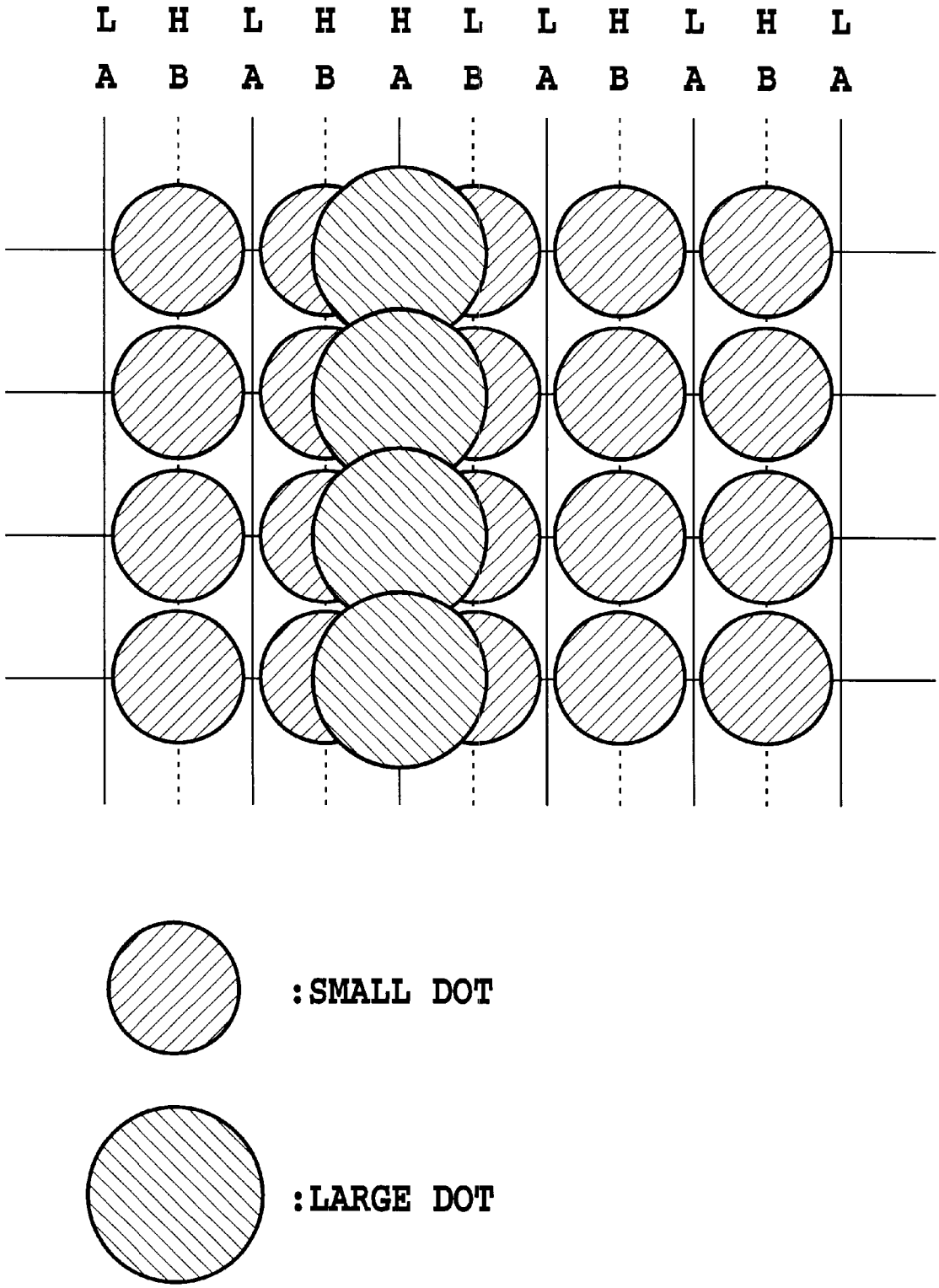
FIG. 20 is a diagram for explaining a print example by the present embodiment.

FIG. 19 shows a problem generated when, for example, one large dot is recorded when the 2-bit print data is "10", in which data of "10" is recorded between the image of print data "01", and a space is generated at the part where the image density is changed. FIG. 20 shows a print example of the present embodiment which eliminates the problem.

Figure 21:
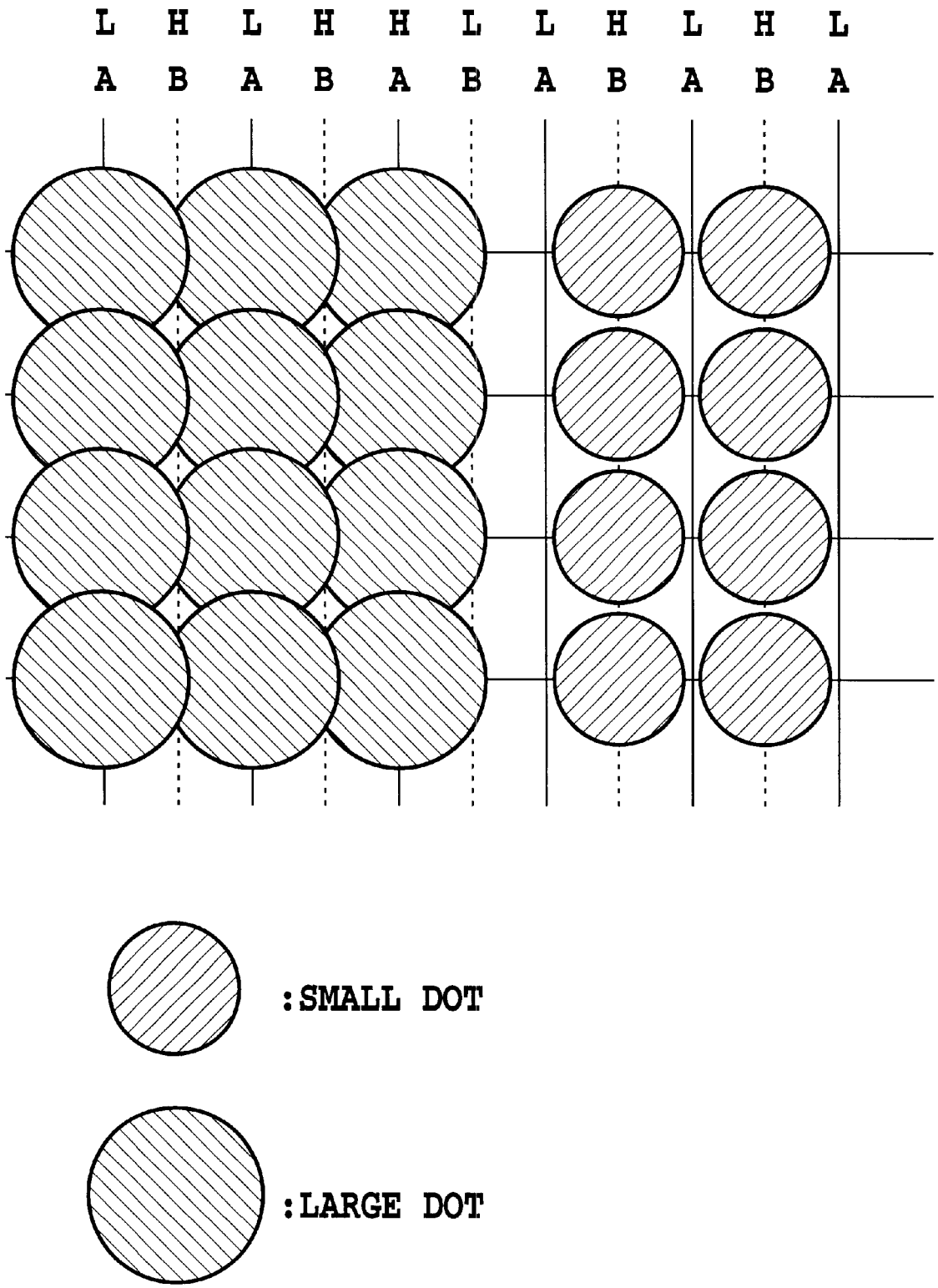
FIG. 21 is a diagram explaining a problem in a print example by a prior art printing method.
Figure 22:
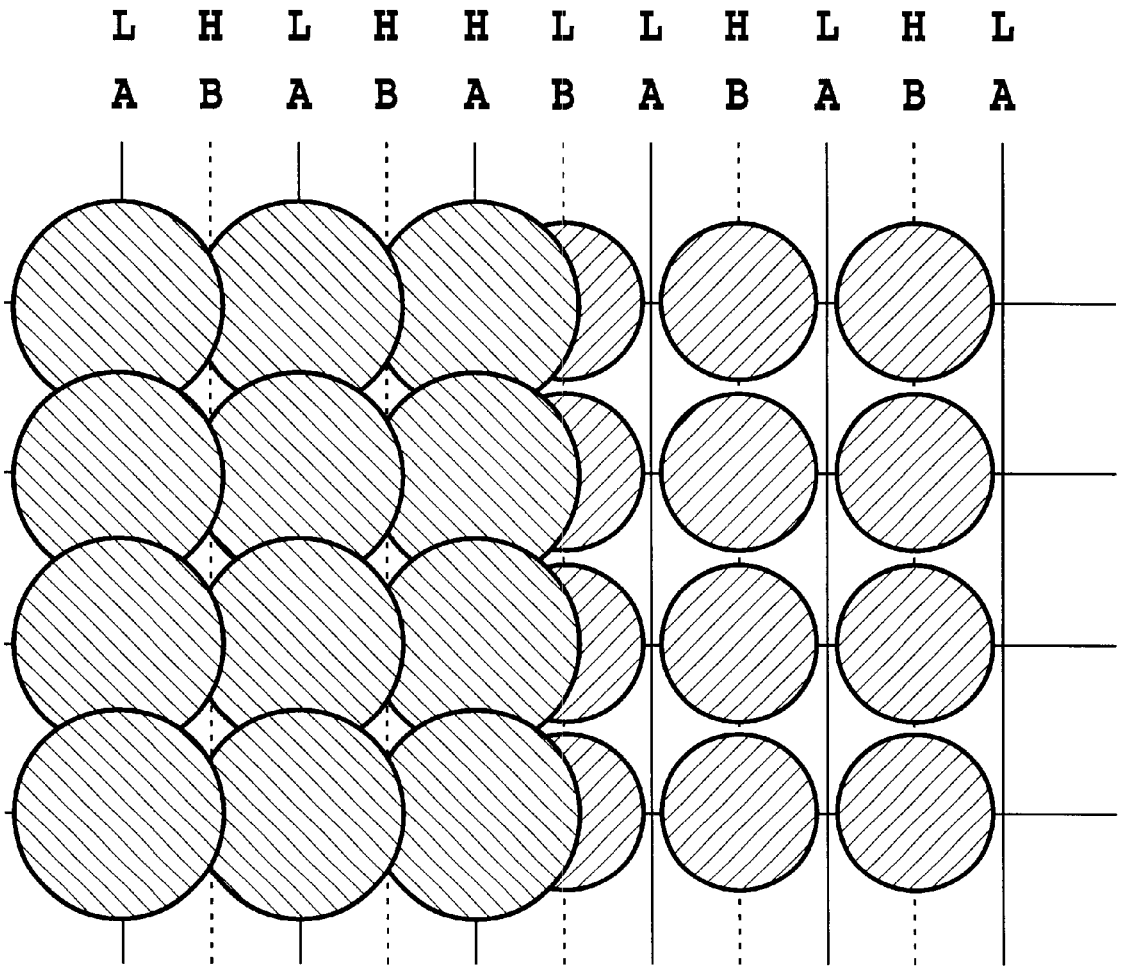
FIG. 22 is a diagram showing a print example by the present embodiment.
Figure 22:
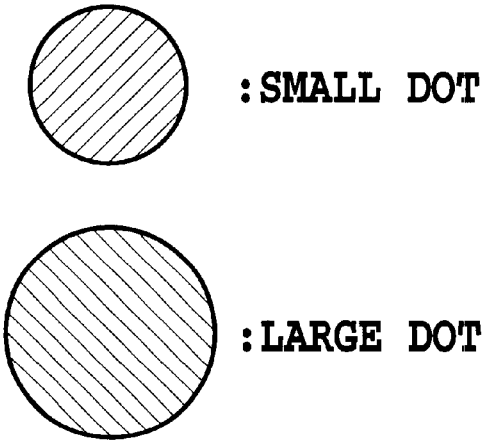

Similarly, FIG. 21 shows a print example having a boundary area between a high density area and a low density area. In this case when the processing is made as in FIG. 19, a space is also generated in the image part between density differences. FIG. 22 shows an example which eliminates the problem.

By making recording with such bit arrangement, since respective 2-bit data are uniformly and randomly distributed to respective recording scans, it is possible to almost completely eliminate the difference in the number of recording dots between respective recording scans.

Further, in the present embodiment, by using a 2-bit code decode table, distribution of large and small dots is also shuffled mixedly in the 2-bit sets. Therefore, even in a case that the numbers of large dots and small dots are extremely biased, it is possible to distribute respective dot sizes uniformly in respective recording scans. When this function is effectively utilized, as compared with the prior art in which the dynamic range has been up to a maximum of two dots and the number of gradations up to three gradations, by using the head capable of recording large and small dots, printing in multipass, decoding by 2-bit code, random conversion data and the like in the present embodiment, printing can be performed by combining a maximum of three large dots and three small dots, and as selectable combinations, four of 16 gradations can be flexibly selected. Further, by increasing the number of passes of multipass printing, and by increasing the number of bits from 2-bit code to 3-bit or 4-bit code, gradation expression capacity can be increased extremely, thereby increasing the dynamic range. Still further, an increased number of gradation modulations may be used rather than two gradations of large and small.

Figure 23:
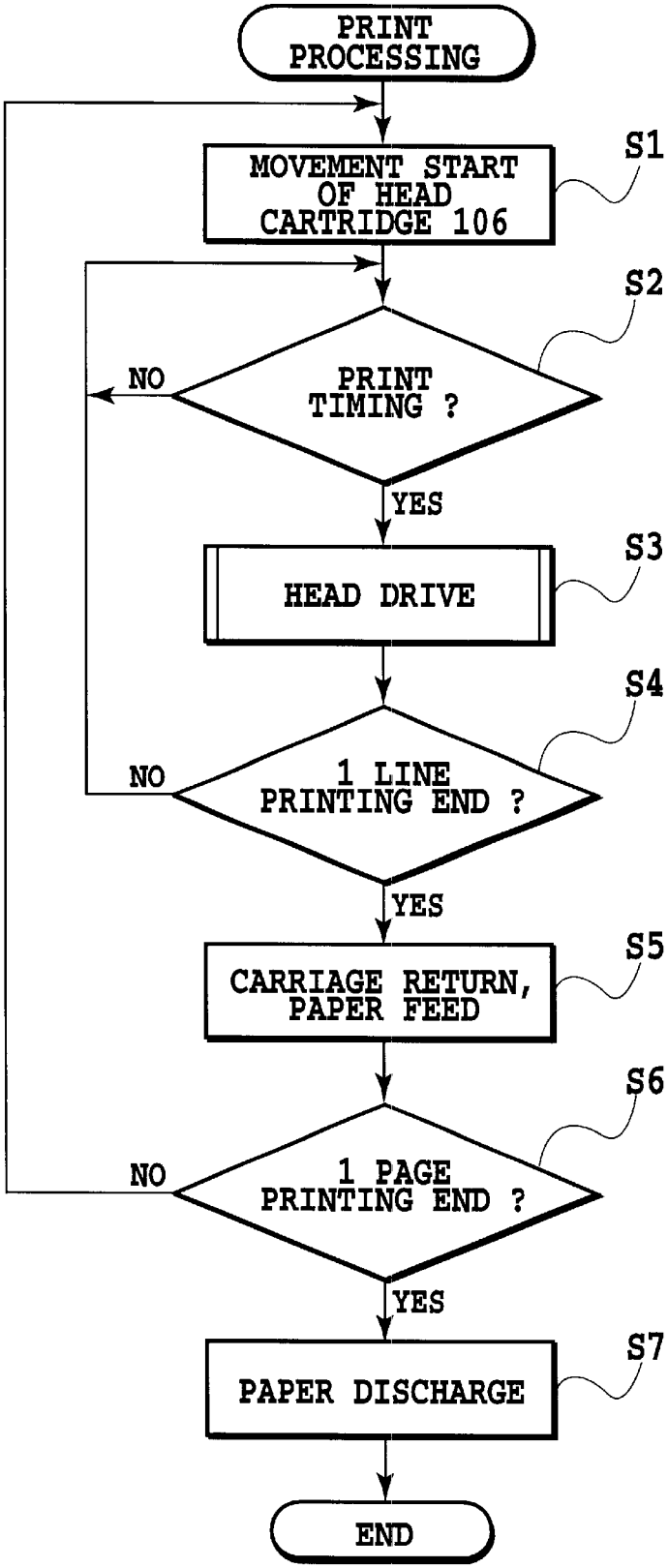
FIG. 23 is a flow chart showing an example of print processing procedure in the ink-jet recording apparatus of the present embodiment.

FIG. 23 is a flow chart showing an example of printing processing procedure in the ink-jet printer of the present embodiment. A program (stored in a ROM 102) corresponding to the processing procedure is executed under the control of the MPU 101. Further, this processing is started by receiving data from a host computer H to store print data for at least one scan or one page. Still further, this procedure is adapted particularly to 1-pass recording.

First, in step S1, drive of the carriage motor 6 is started to start movement of the head cartridge 1, in step S2, when the print timing by the head comes, the processing goes to step S3, where the head is driven to effect recording of an amount of one line of nozzles (flow chart in FIG. 24 will be described later), and in step S4, a determination is made as to whether or not print processing of one line is completed. When print processing of one line is not completed, the processing returns to step S2, and when print processing of one line is completed, the processing goes to step S5, where carriage return and feeding of the recording paper of a length corresponding to the recording width (discharge port arrangement area) are performed, and the processing goes to step S6. In step S6, a determination is made as to whether or not printing of one page is completed, if not completed the processing returns to step S1, and if completed the processing goes to step S7, and the recorded paper is discharged.

Figure 24:
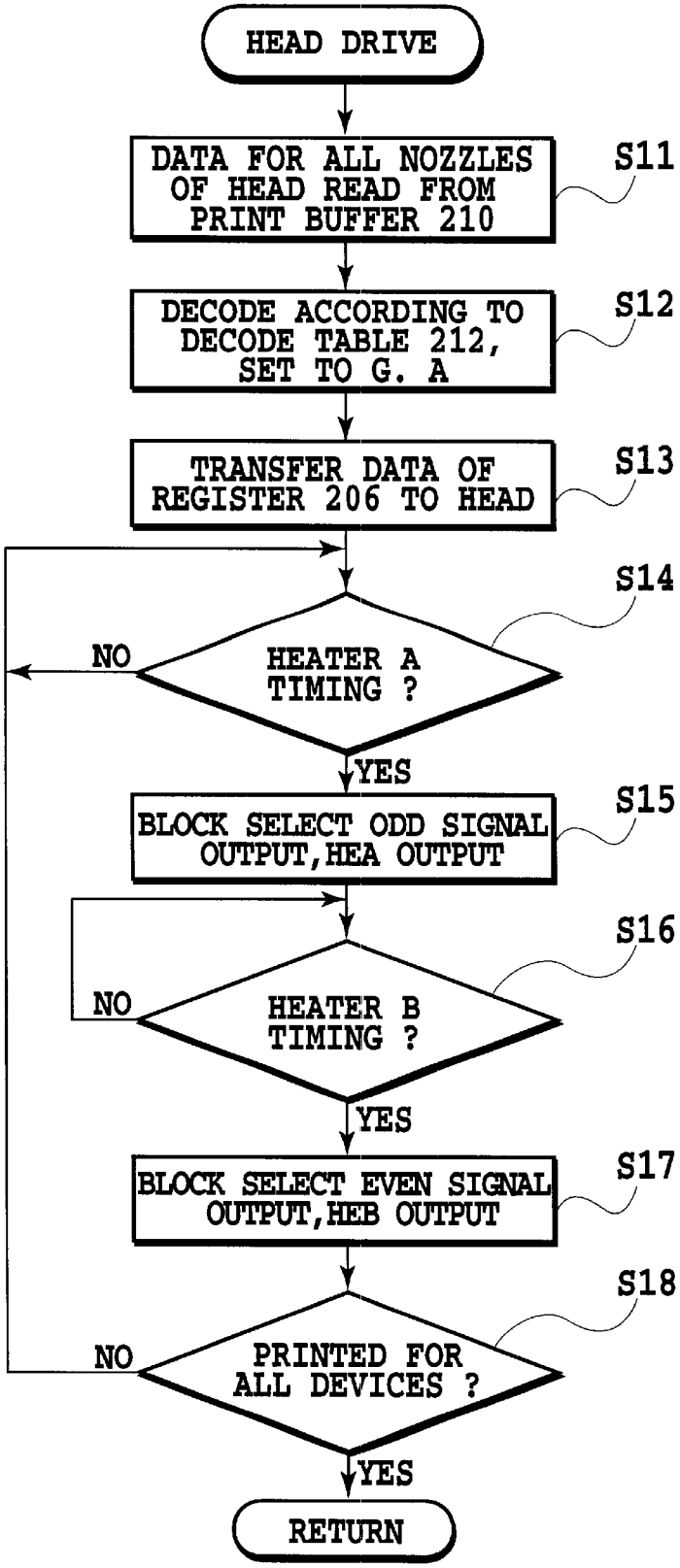
FIG. 24 is a flow chart showing an example of head drive processing procedure in FIG. 23.

Next, head drive processing in the ink-jet printer of the present embodiment will be described with reference to the flow chart of FIG. 24.

First, in step S11, print data of one line of head nozzles is read from the print buffer 210, and the data is passed through the data converter 204 to be decoded by the decoder 205, and set in the registers 206*a* and 206*b* (by way of DMA) of the G. A. 104. The data set in these registers 206*a* and 206*b* is transferred to the shift register 207 of the head 21. In the present embodiment, since one gradation dot (comprising a maximum of two dots) is formed by driving each of heater A and heater B of each nozzle, first in step S14 a determination is made as to whether or not it is drive timing of the heater A. When the determination result is affirmative, the processing goes to step S15, where a block select signal 624 and odd/even signal 625 are outputted to determine nozzles to be simultaneously driven. Then, a signal 627 for driving the heater A is outputted. This forms a large dot if the data corresponding to the selected nozzle is "1".

Next, going to step S16, a determination is made as to whether or not it is drive timing of the heater B; when it is drive timing of the heater B, the processing goes to step S17, where the block select signal 624 and odd/even signal 626 are outputted to determine the nozzle for next driving the heater B, and output the heat signal 626. This forms a small dot by that nozzle if the data corresponding to the nozzle is "1".

Going to step S18, a determination is made as to whether or not all nozzles of the head are driven to perform printing; if YES the processing returns to the original processing, if not the processing returns to step S14, and next heater A timing and heater B timing are checked to successively perform printing by other nozzles.

Figure 25:
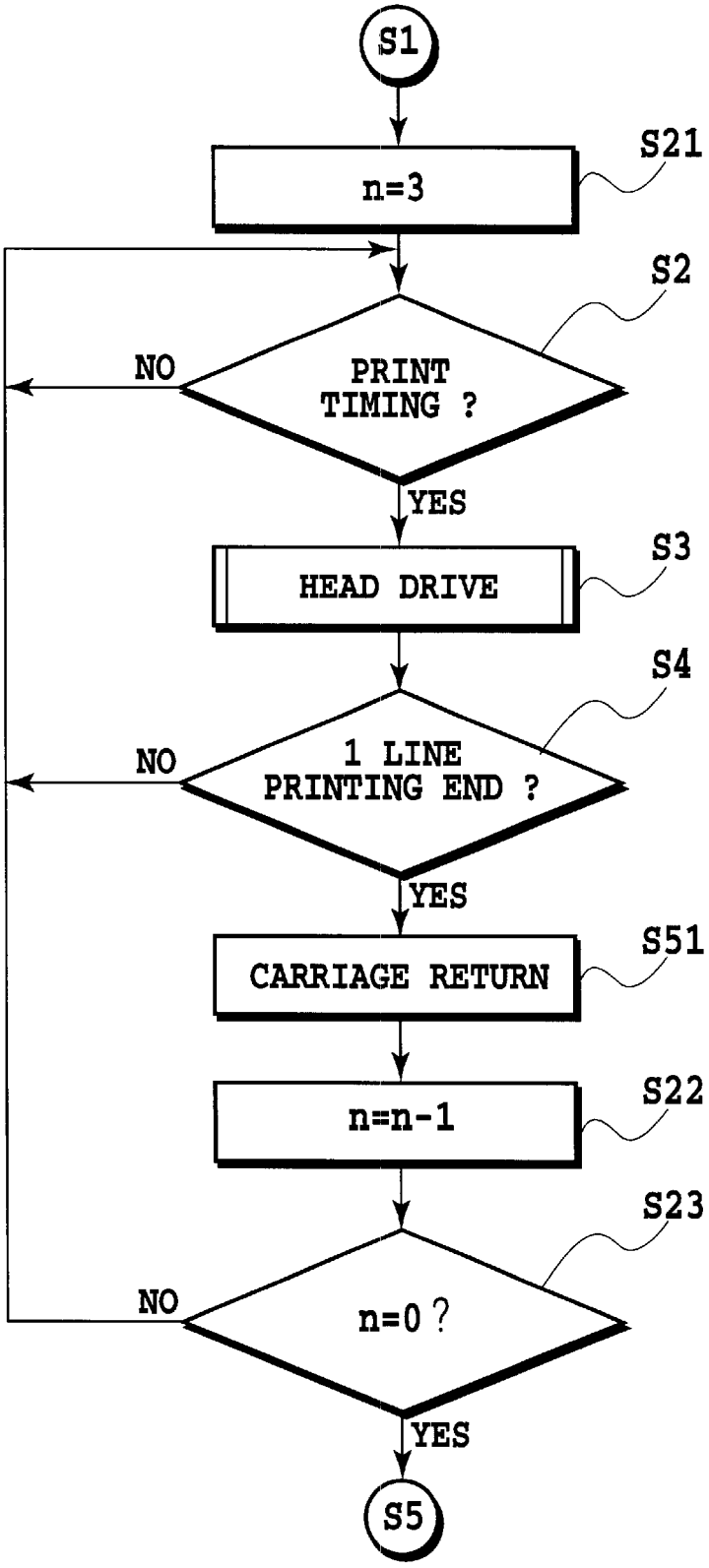
FIG. 25 is a flow chart showing an example of processing procedure when recording is performed in three passes by the apparatus of the present embodiment.

FIG. 25 is a flow chart showing processing in the case of performing printing by 3-pass in the present embodiment, showing part which can be inserted between step S1 and step S5 in the above described flow chart of FIG. 23.

Here, this can be easily achieved by setting n=3 in step S21, and performing head driving of step S2 to S23 until n=0 is reached in step S23. In this case, data recorded corresponding to respective recording scans are formed by the data converter 204 and the decoder 205 of FIG. 11.

Figure 26:
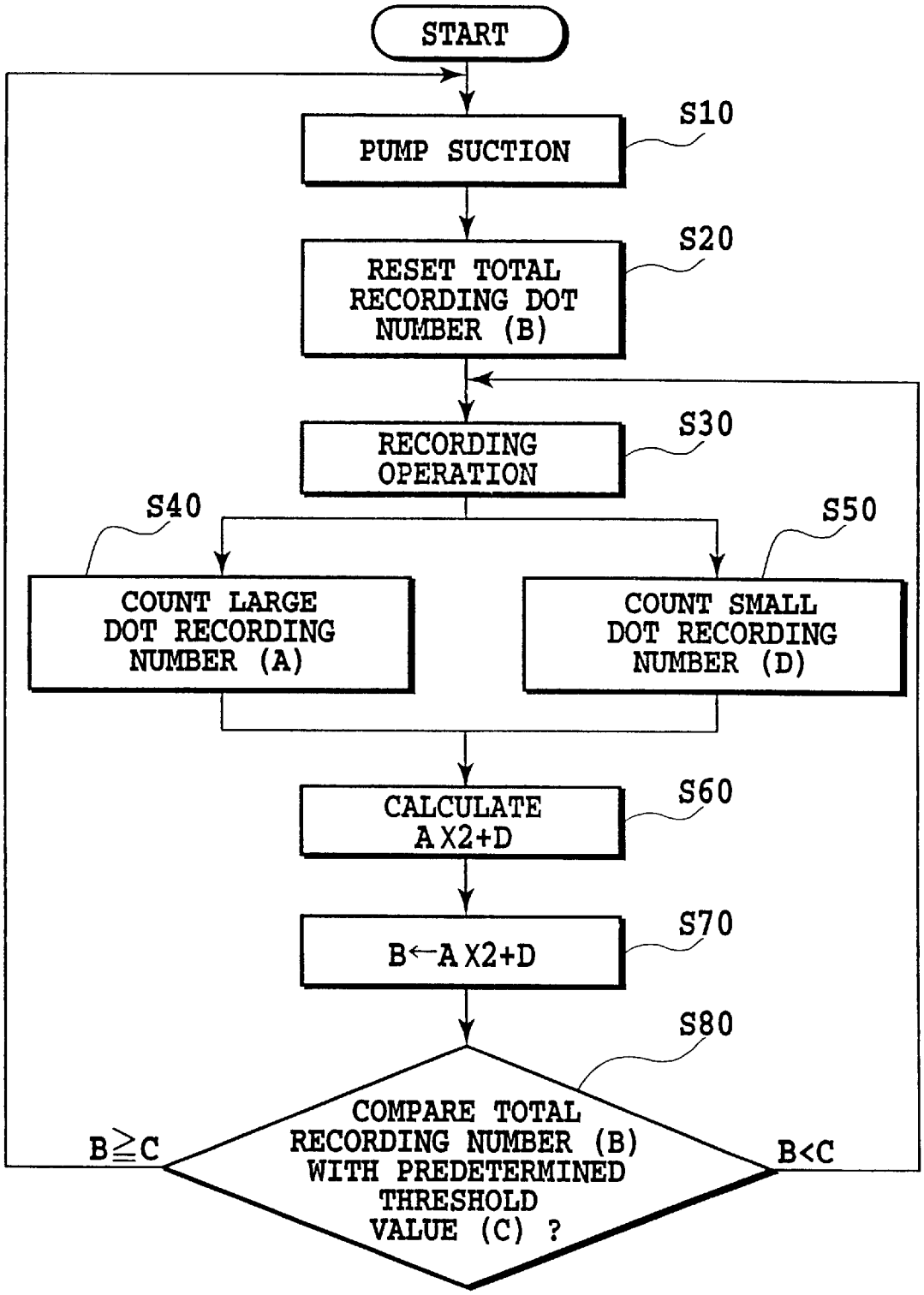
FIG. 26 is a flow chart showing a suction operation processing according to the present embodiment.

FIG. 26 shows an example of processing procedure for controlling starting of suction operation when a head capable of discharging large dots and small dots from the same head is used as in the present embodiment. In step S10, suction is performed using a pump, and in step S20, a total number of recording dots B stored in the EEPROM 1011 is reset. Then, in step S30, entering the above-described recording operation, the number of ink discharge times during the recording operation are separately counted for large dot recording number A and small dot recording number D, respectively, in step S40 and S50. In this case, since an electrical signal for discharging a large dot sent to the discharge heater and an electrical signal for discharging a small dot can be distinguished from each other, A and D can be counted separately. Next, in step S60, for example, A×2+D is calculated, the value is determined to be a total recording dot number B in step S70, and the value is stored in the EEPROM. In the present embodiment, since the ratio of the discharge amount of a large dot and the discharge amount of a small dot is assumed to be 2:1, A is multiplied by 2, which is of course a value that can be independently set according to the design of the print head, and an optimum value can be selected every time.

In step S80, a comparison is made between the total recording dot number B with a threshold value (a value for determining at what value of total recording dot number the suction operation is to be performed); if B<C, the processing returns to step S30 to continue the recording operation, if B>C, the processing returns to step S10 to perform pump suction.

As described above, according to the present embodiment, large dots and small dots are separately counted, and the suction operation can be performed when the total recording dot number, taking a difference between the respective discharge amounts into consideration, exceeds a predetermined threshold value, thereby preventing waste consumption of ink due to starting of unnecessary suction operation and preventing unnecessary time consumption for suction operation. Further, this control method is very advantageous in terms of ink consumption, leading to a cost reduction.

As described above, calculation of the ink consumption according to the present invention is performed by counting the number of ink discharges corresponding to each of ink droplets in different discharge amounts, and using the count values corresponding to such ink droplets in different discharge amounts.

The ink consumption can be calculated precisely by computing the count value according to the rate corresponding to the discharge amount of ink that can be varied depending upon a head construction.

This construction of the present invention makes it possible to precisely calculate the ink consumption in the ink-jet recording apparatus that effects recording on a recording medium using an ink-jet head capable of changing the ink discharge amount. Further, the construction makes it possible to timely execute an operation for stabilizing a head discharge state based upon the amount of discharged ink.

Second Embodiment

Figure 27:
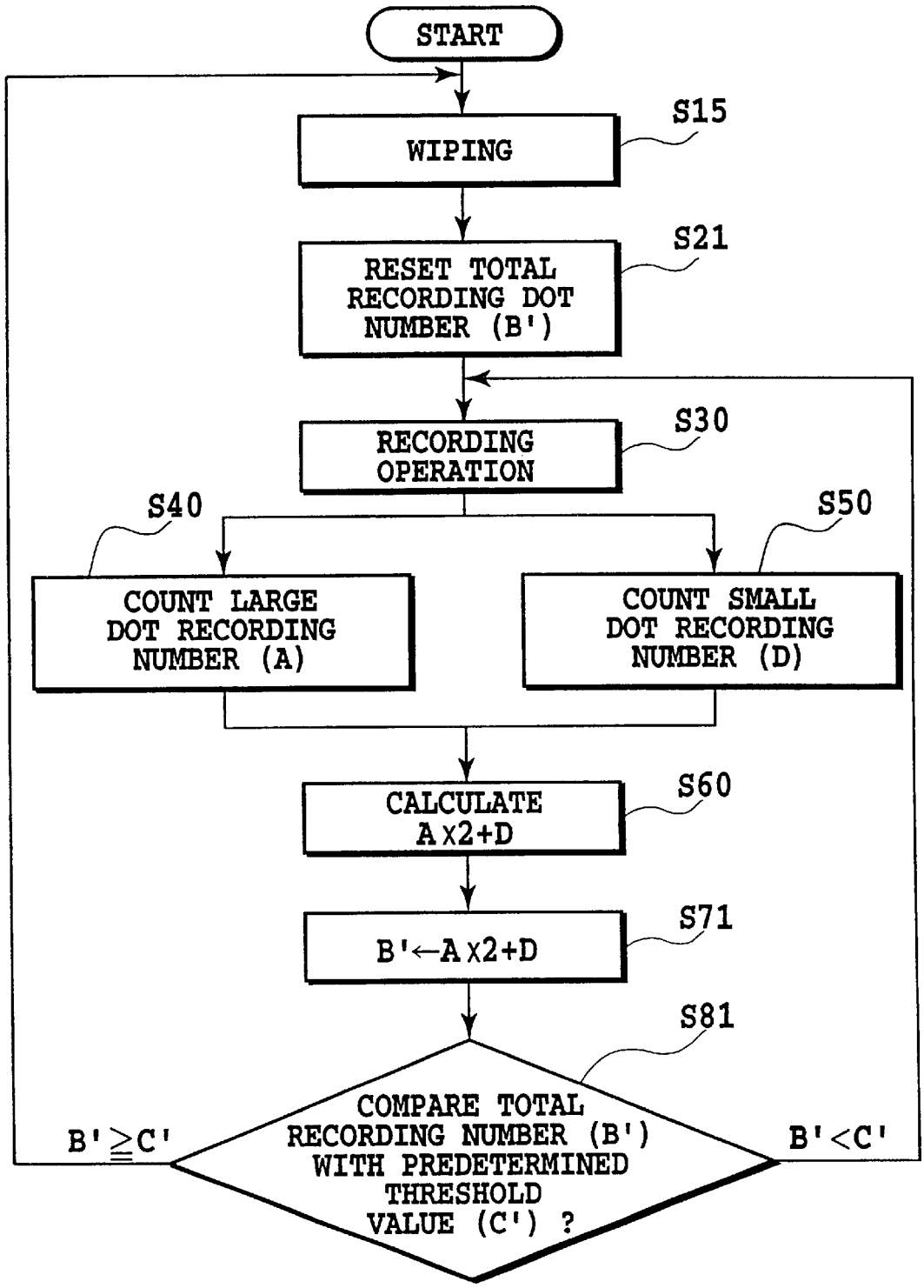
FIG. 27 is a flow chart showing a wiping operation processing according to another embodiment of the present invention.

FIG. 27 shows an example of processing procedure for controlling the wiping operation in the same construction as in the first example. Wiping is performed in step S15, and a total recording dot number B' is reset in step S21. Next, entering the recording operation in step S30, large dot recording number A and small dot recording number D are respectively counted in steps S40 and S50.

Next, in step S60, A×2+D is calculated, and the value is determined as the total recording dot number B' in step S71. Instep S81, the total recording dot number B' is compared with a predetermined threshold value C', and if B'<C', the processing returns to S30 to perform the recording operation. If B'≧C', the processing returns to step S15 to perform wiping.

As described above, according to the present embodiment, large dots and small dots are separately counted, and the wiping operation can be performed when the total recording dot number, taking a difference between the respective discharge amounts into consideration, exceeds a predetermined threshold value, thereby preventing unnecessary time consumption for the wiping operation. Further, this control method is also very advantageous in terms of durability of the member for wiping and the recording head.

Further, as a modified embodiment, the above first embodiment and this second embodiment can of course be combined. In this case, the values C and C' for determining execution of the respective operations may be equal to each other, and when suction and wiping are started in synchronization, B and B' can be stored using a common area. Still further, the values of C and C' may be different so that the respective operations can be started independently.

Third Embodiment

Figure 28:
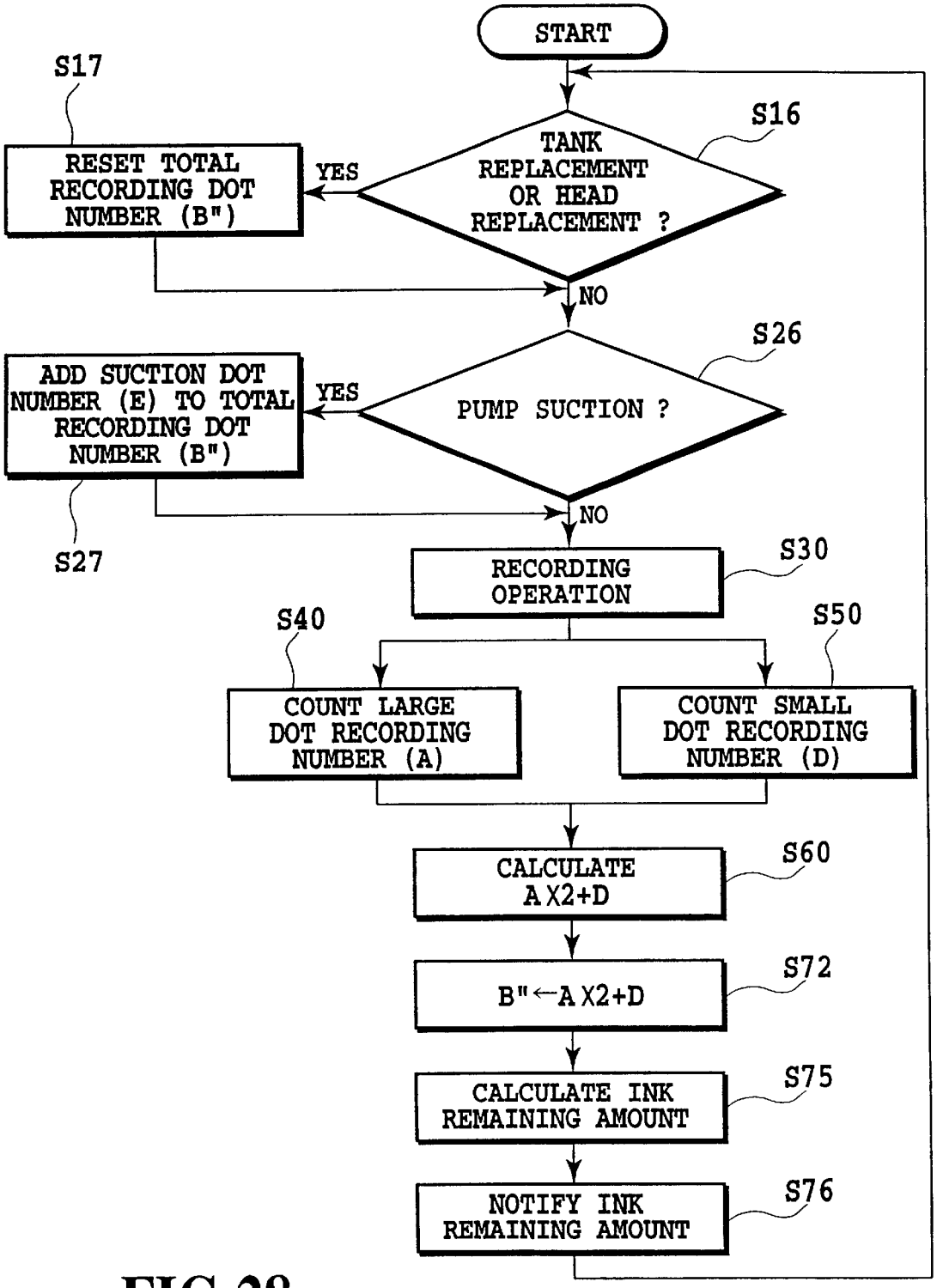
FIG. 28 is a flow chart showing an ink remaining amount detection processing according to a still further embodiment of the present invention.
Figure 29A:
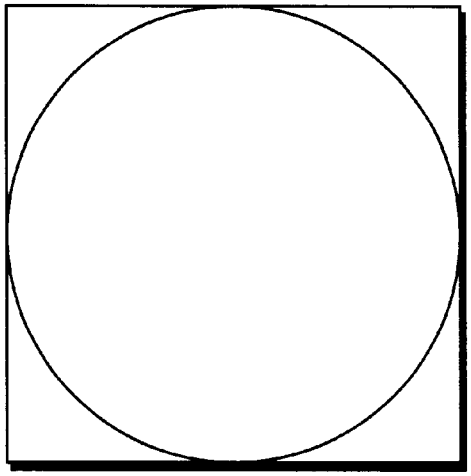
FIGS. 29A and 29B are diagrams for explaining the relation between a conventional dot diameter and data amount.
Figure 29B:
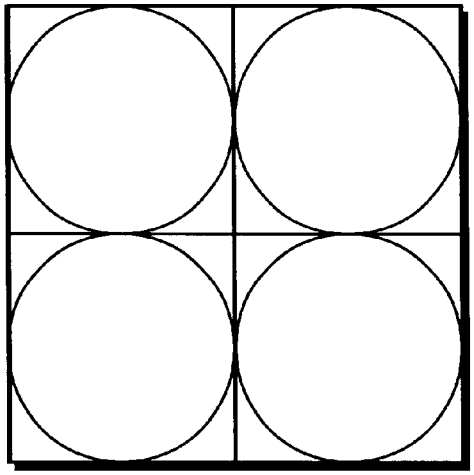

FIG. 28 shows an example of processing procedure for performing ink remaining amount detection in an ink tank as an ink supply source in the same construction as in the first embodiment. Tank replacement or head cartridge replacement is performed in step S16; when the ink tank used is replaced, the total recording dot number B" is reset in step S17, and then the processing goes to step S26. When it is determined that no tank replacement nor head cartridge replacement is performed in step S16, the processing, as is, goes to step S26. When pump suction is performed in this step, the number of dots (suction dot number) corresponding to the suction amount is added to the total recording dot number B" in step S27 and then the recording operation is performed in step S30. When pump suction is not performed in step S26, the processing enters, as is, the recording operation.

In step S40, the large dot recording number A is counted, and in step S50, on the other hand, the small dot recording number D is counted. Next, in step S60, A×2+D is calculated, and the value is determined as the total dot number B" in step S72. Next, in step S75, the ink remaining amount is calculated (for example, total dot number B" is subtracted from a recordable dot number corresponding to an initial ink charge amount), and in step S76, the ink remaining amount is informed (a display panel provided on the printer main unit or a display of the host computer H can be used). After that, the processing returns to step S16.

According to the above-described present embodiment, large dots and small dots are separately counted, and exact ink remaining amount detection in the ink tank, taking the difference in discharge amount between the respective dots into consideration, can be performed when using a head capable of recording large and small dots. This is advantageous in view of user interface.

Of course, the above-described combination of the first embodiment and/or second embodiment is also possible for the present embodiment.

In the above-described respective embodiment, large and small dots are separately counted and a predetermined calculation is performed; however, alternatively, a predetermined processing may be performed according to the dot size, and then counting of the combined value of large and small dots can be performed collectively. For example, 2 can be added for a large dot. Alternatively, a summed value corresponding to large dots and small dots included in one pixel is determined according to the 2-bit print data, which may be counted.

In addition, although the above embodiments show cases of processing two types of dots, large and small, the types of dot sizes are not limited to that in the described embodiments.

The present invention achieves distinct effects when applied to a recording head or a recording apparatus which has means for generating thermal energy, such as electrothermal transducers or laser light, and which causes changes in ink by the thermal energy so as to eject the ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied to either on-demand-type or continuous-type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is applicable to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink-jet recording apparatus for effecting recording using an ink-jet recording head capable of discharging an ink from a discharge port, said apparatus comprising:

ink discharge amount changing means for changing an ink discharge amount from the ink-jet recording head by selectively ejecting ink droplets of different sizes;

accumulation means for accumulating data corresponding to the ink discharge amount from the ink-jet recording head, said accumulation means counting numbers of respective discharges of the ink droplets of each discharge amount set by said ink discharge amount changing means to accumulate data corresponding to a total ink discharge amount; and control means for performing processing for maintaining an ink discharge operation according to the accumulated data corresponding to the total amount of ink discharged from the ink-jet head, wherein the recording operation of the ink-jet recording head is effected by selectively discharging the ink droplets of different discharge amounts by said ink discharge amount changing means, based upon data which corresponds to each of the ink droplets of different sizes.

2. The ink-jet recording apparatus as claimed in claim 1, wherein the processing for maintaining the discharge operation includes at least one of a recovery processing for maintaining ink discharge performance of the ink-jet recording head, and a processing for detecting an ink remaining amount of an ink supply source for the ink-jet recording head.

3. The ink-jet recording apparatus as claimed in claim 2, wherein said recovery processing includes at least one of an elimination processing for forcibly eliminating ink from the discharge port, and a cleaning processing for cleaning a surface provided with the discharge port of the ink-jet recording head.

4. The ink-jet recording apparatus as claimed in claim 3, wherein said control means, in the processing for detecting the ink remaining amount, considers data corresponding to an amount of forcibly eliminated ink.

5. The ink-jet recording apparatus as claimed in claim 3, wherein said elimination processing includes a suction processing for suctioning ink from the discharge port, and said cleaning processing includes a processing for wiping the discharge port surface.

6. The ink-jet recording apparatus as claimed in claim 1, wherein said ink discharge amount changing means controls the ink-jet recording head so that at least two types of droplets, large and small, are discharged onto a recording medium, and said accumulation means comprises droplet count means for separately counting the number of discharges of the large droplets and the number of discharges of the small droplets.

7. The ink-jet recording apparatus as claimed in claim 1, wherein said ink discharge amount changing means controls the ink-jet recording head to be able to form at least two types of dots, large and small, on a recording medium, and said accumulation means collectively counts data corresponding to discharge operations for forming large dots and data corresponding to discharge operations for forming small dots.

8. The ink-jet recording apparatus as claimed in claim 1, wherein said ink-jet recording head comprises a plurality of heat generation resistors, substantially differing in heat generation amount capability, for generating thermal energy as an energy utilized for discharging ink, or a plurality of heat generation resistors substantially same in heat generation amount capability, disposed corresponding to the discharge port.

9. The ink-jet recording apparatus as claimed in claim 8, wherein said ink discharge amount changing means selectively drives said plurality of heat generation resistors.

10. The ink-jet recording apparatus as claimed in claim 8, wherein each of said heat generation resistors generates the thermal energy for causing the ink to undergo film boiling.

11. A control method of an ink-jet recording apparatus for effecting recording using an ink-jet recording head capable of discharging an ink from a discharge port, said method comprising:

an ink discharge amount changing step of changing an ink discharge amount from the ink-jet recording head by selectively ejecting ink droplets of different sizes;

an accumulation step of accumulating data corresponding to the ink discharge amount from the ink-jet recording head, said accumulation step counting numbers of respective discharges of the ink droplets of each discharge amount set in said ink discharge amount changing step to accumulate data corresponding to a total ink discharge amount; and a control step of performing processing for maintaining an ink discharge operation according to the accumulated data corresponding to the total amount of ink discharged from the ink-jet head, wherein the recording operation of the ink-jet recording head is effected by selectively discharging the ink droplets of different discharge amounts in said ink discharge amount changing step, based upon data which corresponds to each of the ink droplets of different sizes.

12. The control method of an ink-jet recording apparatus as claimed in claim 11, wherein the processing for maintaining the discharge operation includes at least one of a recovery processing for maintaining ink discharge performance of the ink-jet recording head, and a processing for detecting an ink remaining amount of an ink supply source for the ink-jet recording head.

13. The control method of an ink-jet recording apparatus as claimed in claim 12, wherein said recovery processing includes at least one of an elimination processing for forcibly eliminating ink from the discharge port, and a cleaning processing for cleaning a surface provided with the discharge port of the ink-jet recording head.

14. The control method of an ink-jet recording apparatus as claimed in claim 13, wherein said control step, in said processing for detecting the ink remaining amount, considers data corresponding to an amount of forcibly eliminated ink.

15. The control method of an ink-jet recording apparatus as claimed in claim 13, wherein said elimination processing includes a suction processing for suctioning ink from the discharge port, and said cleaning processing includes a processing for wiping the discharge port surface.

16. The control method of an ink-jet recording apparatus as claimed in claim 11, wherein said ink discharge amount changing step controls the ink-jet recording head so that at least two types of droplets, large and small, are discharged onto a recording medium, and said accumulation step comprises a droplet count step for separately counting the number of discharges of the large droplets and the number of discharges of the small droplets.

17. The control method of an ink-jet recording apparatus as claimed in claim 11, wherein said ink discharge amount changing step controls the ink-jet recording head to be able to form at least two types of dots, large and small, on a recording medium, and said accumulation step collectively counts data corresponding to discharge operations for forming large dots and data corresponding to discharge operations for forming small dots.

18. The control method of an ink-jet recording apparatus as claimed in claim 11, wherein the ink-jet recording head comprises a plurality of heat generation resistors, substantially differing in heat generation amount capability, for generating thermal energy as an energy utilized for discharging ink, or a plurality of heat generation resistors substantially same in heat generation amount capability, disposed corresponding to the discharge port.

19. The control method of an ink-jet recording apparatus as claimed in claim 18, wherein said ink discharge amount changing step selectively drives the plurality of heat generation resistors.

20. An ink-jet recording apparatus for effecting recording using an ink-jet head capable of changing a discharge amount of ink, said apparatus comprising:

discharge control means for driving the ink-jet head based upon data which corresponds to each of discharge amounts of ink droplets to thereby discharge ink in the form of the droplets of different discharge amounts; and calculating means for calculating total ink consumption due to discharge according to driving of the ink-jet head by said discharge control means, said calculating means counting the number of ink discharges corresponding to each of the droplets of each of the different discharge amounts, to thereby calculate the total ink consumption.

21. An ink consumption calculating method in an ink-jet recording apparatus for effecting recording on a recording medium using an ink-jet head capable of changing a discharge amount of ink, said method comprising the steps of:

discharging the ink in the form of droplets of different discharge amounts by driving the ink-jet head based upon data which corresponds to each of the discharge amounts of ink droplets;

counting the number of ink discharges corresponding to each of the ink droplets of each of the different discharge amounts; and calculating total ink consumption based upon a count value corresponding to the counted ink droplets, respectively, in said counting step.

* * * * *